US010867533B2

(12) United States Patent
Laforce et al.

(10) Patent No.: US 10,867,533 B2
(45) Date of Patent: Dec. 15, 2020

(54) LIGHT-EMITTING SIGN APPARATUS

(71) Applicant: TRAFIC INNOVATION INC., Saint-Eustache (CA)

(72) Inventors: Robert Laforce, Sainte-Anne-des-Lacs (CA); Patrice Arteau, Saint-Colomban (CA); Luc Belanger, Laval (CA)

( * ) Notice: Subject to any disclaimer, the term of this patent is extended or adjusted under 35 U.S.C. 154(b) by 212 days.

(21) Appl. No.: 15/454,645

(22) Filed: Mar. 9, 2017

(65) Prior Publication Data

US 2017/0301268 A1 Oct. 19, 2017

Related U.S. Application Data

(60) Provisional application No. 62/305,576, filed on Mar. 9, 2016.

(51) Int. Cl.

| | |
|---|---|
| ***G09F 9/33*** | (2006.01) |
| ***G09F 13/18*** | (2006.01) |
| ***G09F 13/04*** | (2006.01) |
| ***G09F 9/302*** | (2006.01) |
| ***G09F 13/00*** | (2006.01) |
| ***G08G 1/095*** | (2006.01) |
| ***G09F 13/16*** | (2006.01) |
| ***G09F 27/00*** | (2006.01) |
| *G09F 13/22* | (2006.01) |

(52) U.S. Cl.

CPC ..... *G09F 9/33* (2013.01); *G08G 1/095* (2013.01); *G09F 9/302* (2013.01); *G09F 13/005* (2013.01); *G09F 13/0413* (2013.01); *G09F 13/16* (2013.01); *G09F 13/18* (2013.01); *G09F 27/005* (2013.01); *G09F 27/007* (2013.01); *G09F 2013/0472* (2013.01); *G09F 2013/222* (2013.01)

(58) Field of Classification Search

CPC ..... G09F 9/33; G09F 9/302; G09F 13/005; G09F 13/0413; G09F 27/007; G09F 2013/0472; G08G 1/095

See application file for complete search history.

(56) References Cited

U.S. PATENT DOCUMENTS

| | | | | |
|---|---|---|---|---|
| 4,117,616 | A * | 10/1978 | Penton | G09F 13/16 40/550 |
| 4,186,376 | A * | 1/1980 | Uchida | G09F 13/04 340/461 |
| 6,198,410 | B1 * | 3/2001 | White | G09F 9/307 340/907 |
| 6,204,777 | B1 * | 3/2001 | Lyons | G08G 1/0955 340/321 |
| 2002/0157292 | A1 * | 10/2002 | Landers, Jr. | G02B 6/0065 40/546 |
| 2003/0106247 | A1 * | 6/2003 | Huang | G09F 7/04 40/452 |
| 2005/0231949 | A1 * | 10/2005 | Kim | G09F 9/33 362/249.01 |

(Continued)

*Primary Examiner* — Gary C Hoge

(57) ABSTRACT

A light-emitting sign comprising a light source for emitting light, in which the light-emitting sign may be thin (e.g., comparable to a conventional non-light-emitting sign) while creating a desired visual effect using the light emitted by the light source. This may be achieved, for example, by the light source being thin itself and/or by having an external device connected to the light-emitting sign and implementing certain functionalities (e.g., powering and/or controlling the light source).

55 Claims, 27 Drawing Sheets

(56) References Cited

U.S. PATENT DOCUMENTS

2006/0012487 A1* 1/2006 Gibson ..... G08B 5/006 340/815.45
2006/0061487 A1* 3/2006 Heap ..... G09F 13/22 340/908
2008/0060234 A1* 3/2008 Chou ..... G09F 9/33 40/452
2009/0296387 A1* 12/2009 Reisenauer ..... F21V 3/00 362/235
2010/0059783 A1* 3/2010 Chandra ..... H01L 33/62 257/99
2011/0013391 A1* 1/2011 Chen ..... F21V 15/01 362/235
2011/0119975 A1* 5/2011 Kuo ..... G09F 9/33 40/578
2011/0138663 A1* 6/2011 Chen ..... G09F 9/33 40/541
2011/0170283 A1* 7/2011 Chan ..... G09F 9/33 362/183
2011/0308120 A1* 12/2011 Heo ..... G09F 9/33 40/541
2012/0139888 A1* 6/2012 Fujimori ..... G09F 27/007 345/211
2012/0204455 A1* 8/2012 Mothaffar ..... G09F 13/22 40/610
2012/0206277 A1* 8/2012 Cai ..... G09F 13/22 340/928
2013/0153943 A1* 6/2013 Lee ..... H01L 33/64 257/91
2013/0301138 A1* 11/2013 Cai ..... G09F 13/02 359/619
2014/0183948 A1* 7/2014 Hulbert ..... H02J 7/0063 307/23
2015/0089849 A1* 4/2015 Fakhari ..... G09F 13/02 40/541
2015/0233565 A1* 8/2015 Lee ..... F21V 29/58 362/555
2016/0026192 A1* 1/2016 Phillips ..... E21B 47/00 348/143
2016/0305079 A1* 10/2016 Fakhari ..... G09F 13/22
2016/0379492 A1* 12/2016 Roy ..... G08G 1/09 340/907
2017/0193865 A1* 7/2017 Harel ..... G09F 13/0404
2017/0310139 A1* 10/2017 Weiser ..... G09F 27/005
2018/0033259 A1* 2/2018 Cummings ..... G08B 5/38
2019/0043352 A1* 2/2019 Baek ..... G08G 1/095

* cited by examiner

LIGHT-EMITTING SIGN APPARATUS

CROSS-REFERENCE

This application claims the benefit of U.S. Provisional Patent Application Ser. No. 62/305,576, filed on Mar. 9, 2016, which is hereby incorporated by reference herein.

FIELD

The present disclosure generally relates to light-emitting signage such as light-emitting traffic signs, advertisement signs, and other signs providing information to people looking at them.

BACKGROUND

Light-emitting signage such as light-emitting traffic signs, advertisement signs, and other signs provide information to people looking at them notably by emitting light. For example, light-emitting traffic signs emit light as part of information they convey to users of vehicles on roads, in parking areas, etc.

While light-emitting traffic signs and other signs have evolved over time, they may still sometimes present some drawbacks. For instance, light-emitting traffic signs may be significantly bulkier and heavier than conventional non-light-emitting traffic signs and/or be limited in designs of light they can emit.

For these and/or other reasons, there is a need for improvements directed to light-emitting signs.

SUMMARY

According to various aspects, the present disclosure relates to a light-emitting sign comprising a light source for emitting light, in which the light-emitting sign may be thin (e.g., comparable to a conventional non-light-emitting sign) while creating a desired visual effect using the light emitted by the light source. This may be achieved, for example, by the light source being thin itself and/or by having an external device connected to the light-emitting sign and implementing certain functionalities (e.g., powering and/or controlling the light source).

For example, in accordance with an aspect, the present disclosure provides a light-emitting sign. The light-emitting sign comprises a panel, an outer layer and a light source for emitting light. The light source extends between the panel and the outer layer. A thickness of the outer layer is less than a thickness of the panel.

In accordance with another aspect, there is provided a light-emitting sign. The light-emitting sign comprises a panel, an outer layer and a light source for emitting light. The light source extends between the panel and the outer layer. A thickness of the light-emitting sign is no more than 25 millimeters.

In accordance with another aspect, there is provided a light-emitting sign. The light-emitting sign comprises a panel, an outer layer and a light source for emitting light. The light source comprises a plurality of light emitters to emit the light and a base supporting the light emitters. The base is configured to deliver power to the light emitters and is disposed between the panel and the outer layer.

In accordance with another aspect, there is provided a light-emitting traffic sign. The light-emitting sign comprises a panel, an outer layer and a light source for emitting light. The light source extends between the panel and the outer layer. A thickness of the outer layer is less than a thickness of the panel.

In accordance with another aspect, there is provided a light-emitting traffic sign. The light-emitting sign comprises a panel, an outer layer and a light source for emitting light. The light source extends between the panel and the outer layer. A thickness of the light-emitting traffic sign is no more than 25 millimeters.

In accordance with another aspect, there is provided a light-emitting traffic sign. The light-emitting sign comprises a panel, an outer layer and a light source for emitting light. The light source comprises a plurality of light emitters to emit the light and a base supporting the light emitters. The base is configured to deliver power to the light emitters and is disposed between the panel and the outer layer.

In accordance with another aspect, there is provided a light-emitting sign apparatus. The light-emitting sign apparatus comprises a light-emitting sign that comprises a light source for emitting light. The light-emitting sign apparatus also comprises an external device that is connectable to the light-emitting sign. The external device comprises a power supply to power the light source and a controller to control the light source.

In accordance with another aspect, there is provided a light-emitting traffic sign system. The light-emitting traffic sign system comprises a light-emitting traffic sign that comprises a light source for emitting light. The light-emitting traffic sign system also comprises an external device that is connectable to the light-emitting traffic sign. The external device comprises a power supply to power the light source and a controller to control the light source.

These and other aspects of the present disclosure will now become apparent to those of ordinary skill in the art upon review of the following description of embodiments in conjunction with the accompanying drawings.

BRIEF DESCRIPTION OF DRAWINGS

A detailed description of embodiments of the present disclosure is provided below, by way of example only, with reference to drawings annexed hereto, in which.

Figure 1:
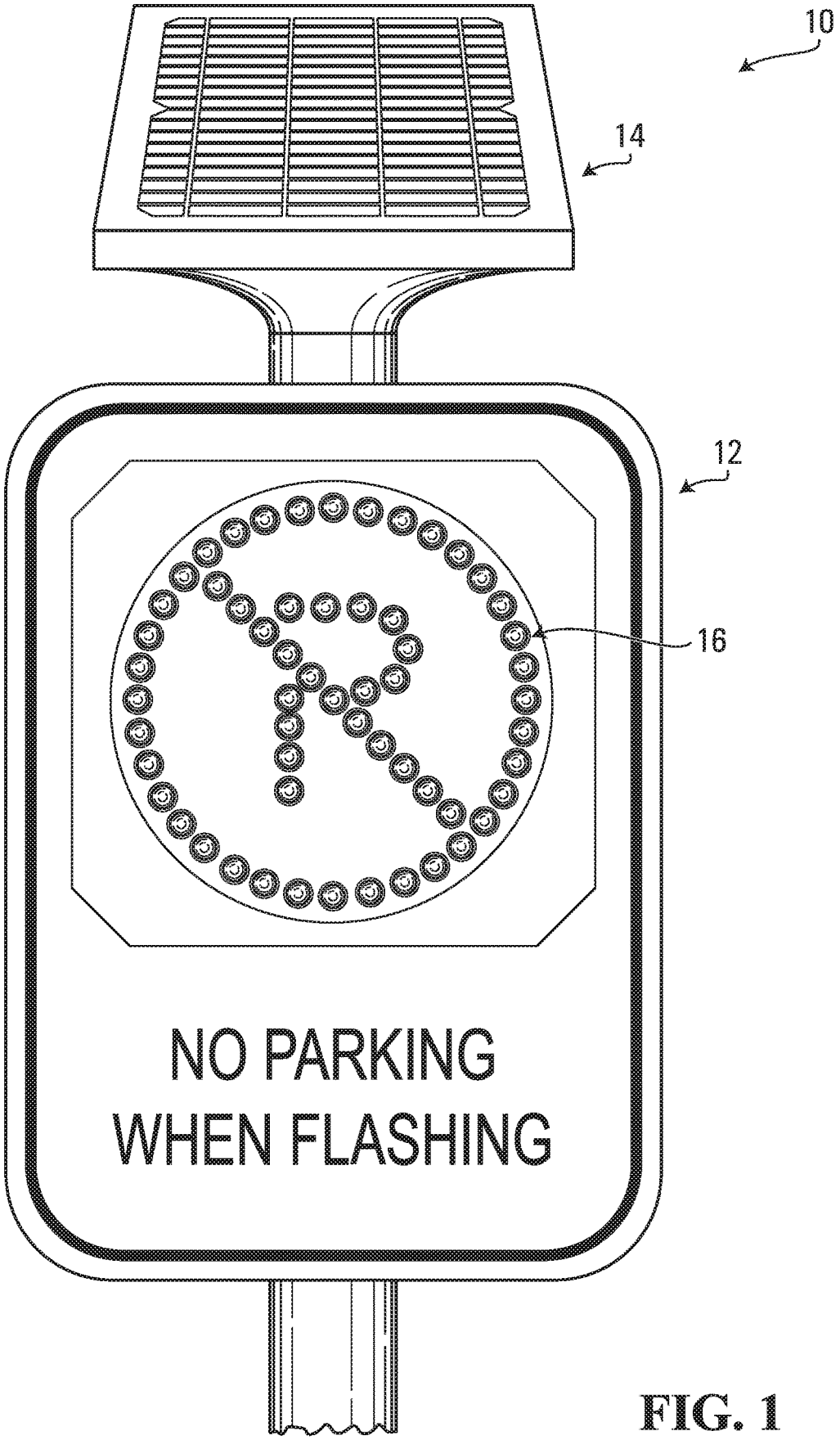
FIG. 1 shows an example of a light-emitting sign apparatus comprising a light-emitting sign and an external device in accordance with an embodiment of the present disclosure.

In the drawings, embodiments of the present disclosure are illustrated by way of example. It is to be expressly understood that the description and drawings are only for purposes of illustration and as an aid to understanding, and are not intended to be a definition of the limits of the invention defined herein.

DETAILED DESCRIPTION OF EMBODIMENTS

FIGS. 1 to 4 show an example of a light-emitting sign apparatus 10 comprising a light-emitting sign 12 for providing information to people viewing it in accordance with an embodiment of the present disclosure. In this embodiment, the light-emitting sign apparatus 10 is a light-emitting traffic sign apparatus and the light-emitting sign 12 is a light-emitting traffic sign for providing information to users of vehicles (e.g., on a road, in a parking lot, etc.).

The light-emitting traffic sign 12 comprises a light source 16 for emitting light to convey the information to the vehicles' users. In this example, the light-emitting traffic sign apparatus 10 also comprises an external device 14 connected to the light-emitting traffic sign 12 to operate the light-emitting traffic sign 12 (e.g., to power and/or control the light source 16).

As further discussed later, in this embodiment, the light-emitting traffic sign 12 may be thin (e.g., compared to a conventional non-light-emitting traffic sign) while creating a desired visual effect using the light emitted by the light source 16. This may be achieved, for example, by the light source 16 being thin itself and by having the external device 14 implement certain functionalities (e.g., powering and/or controlling the light source 16).

The information conveyed by the light-emitting traffic sign 12 may be any desired information. For example, in this embodiment, the information relates to parking of vehicles (e.g., on a street, in parking spot, etc.). More particularly, in this example, the information relates to a restriction on parking of vehicles at certain times, notably when the light source 16 is emitting the light.

The light-emitting traffic sign 12 comprises informational elements $\mathbf{24}_1$-$\mathbf{24}_E$ representing the information that it conveys. In this example, the informational element $\mathbf{24}_1$ is a symbol and the informational element $\mathbf{24}_2$ is text. More particularly, in this example, the symbol $\mathbf{24}_1$ is a prohibitive symbol, which refers to a "no" symbol implemented as a circle $\mathbf{24}_{1a}$ with a diagonal line $\mathbf{24}_{1b}$ surrounding a character or pictogram $\mathbf{24}_{1c}$ used to indicate an action is not permitted, in this case a "P" for "Parking" so as to indicate that no parking is permitted, while the text $\mathbf{24}_2$ expresses that no parking is permitted when the light emitted by the light-emitting sign 12 is flashing. In this embodiment, the light source 16 defines at least part of the informational elements $\mathbf{24}_1$-$\mathbf{24}_E$ of the light-emitting traffic sign 12. Specifically, in this embodiment, the light source 16 defines the symbol $\mathbf{24}_1$, but does not define the text $\mathbf{24}_2$.

In this embodiment, the light-emitting traffic sign 12 comprises the light source 16, a panel 20, and an outer layer 22. In this example, the light source 16 extends between the panel 20 and the outer layer 22. That is, at least part of the light source 16 is disposed between the panel 20 and the outer layer 22. The light-emitting traffic sign 12 comprises a front surface $\mathbf{18}_1$ and a back surface $\mathbf{18}_2$.

The panel 20 is a support supporting components of the light-emitting traffic sign 12, including the light source 16 and the outer layer 22. The panel 20 comprises a front surface $\mathbf{21}_1$ and a back surface $\mathbf{21}_2$. More particularly, in this embodiment, the back surface $\mathbf{21}_2$ of the panel 20 corresponds to the back surface $\mathbf{18}_2$ of the light-emitting traffic sign 12 and the front surface $\mathbf{21}_1$ of the panel 20 faces towards the front surface $\mathbf{18}_1$ of the light-emitting traffic sign 12.

The panel 20 may be shaped in any suitable way. In this example, the panel 20 has a rectangular shape. The panel 20 may have any other shape. For example, the panel 20 may have a shape which conveys information to the vehicles' user. For instance, the panel 20 may have a shape in accordance with a traffic code system, such as an octagonal shape for conveying a "STOP" instruction.

In this embodiment, the panel 20 is metallic. That is, the panel 20 is at least mainly (i.e., mainly or entirely) made of metallic material. For example, in this embodiment, the panel 20 is made of a metal of low density (i.e., light metal), such as low-density steel or aluminium. Alternatively, the panel 20 may be made of a metallic alloy such as, for example, aluminium alloy. The aluminium alloying elements may include, for example, copper, magnesium, manganese, silicon, tin and zinc. In some examples of implementation, the panel 20 may be made of an aluminium blank.

The panel 20 has a thickness $T_P$ from the front surface $\mathbf{21}_1$ to the back surface $\mathbf{21}_2$ of the panel 20. The thickness $T_P$ of the panel 20 may be small. For example, in some embodiments, the thickness $T_P$ of the panel 20 may be no more than 20 millimeters, in some cases no more than 15 millimeters, and in some cases no more than 10 millimeters, in some cases no more than 5 millimeters, in some cases no more than 1 millimeters, and in some cases even less (e.g., 0.8 millimeters). For instance, in some embodiments, the thickness $T_P$ of the panel 20 may be between 10 millimetres and 20 millimetres, in some cases between 5 millimeters and 10 millimeters, and in some cases between 2 millimeters and 5 millimeters.

The panel 20 may be implemented in any other suitable way in other embodiments (e.g., may have any other shape and/or comprise any other material). For instance, in some embodiments, the panel 20 may not be made of a metallic material at all and may rather be made of a non-metallic material, such as plastic material (e.g., acrylic, polycarbonate, high density polyethylene (HDPE)). Moreover, in some cases, the panel 20 may be made of metallic and non-metallic material. For example, in some cases, the panel 20 may be made of an aluminum alloy laminated over a layer of HDPE (e.g., Alupanel®).

The outer layer 22 forms at least part of a periphery of the light-emitting traffic sign 12. In this example, the outer layer 22 conveys at least part of the information provided by the light-emitting traffic sign 12. More particularly, in this embodiment, the outer layer 22 comprises the text $\mathbf{24}_2$ of the light-emitting traffic sign 12. In this example, the text $\mathbf{24}_2$ is implemented as a printed graphic.

In this embodiment, the outer layer 22 is significantly thin. Notably, it is significantly thinner than the panel 20. To that end, in this embodiment, the outer layer 22 comprises a film 25.

More particularly, in this embodiment, the film 25 is reflective (e.g., reflective sheeting). In some cases, the reflective film 25 may be retroreflective (e.g., retroreflective sheeting). Also, in this embodiment, the film 25 is flexible (e.g., flexible reflective sheeting).

For example, in some embodiments, the film 25 may comprise flexible retroreflective sheeting that comprises a flexible plastic surface and glass beads or microprisms embedded into the flexible plastic surface. The reflective sheeting may be colored and/or dyed with a pigment. The retroreflective sheeting may allow the outer surface $\mathbf{18}_2$ of the light-emitting sign 12 to reflect at least a portion of incoming light and to return it towards its originator. For example, the retroreflective sheeting may allow at least a portion of light emitted from headlights of an approaching car to be reflected off the outer surface $\mathbf{18}_2$ and returned towards the car. Such flexible retroreflective sheeting is commonly available from suppliers such as 3M™. In other instances, the outer layer 22 may be made from any other material that allows to reflect light off the outer layer 22 and to return it back to its originator. The outer layer 22 may be resistant to atmospheric agents such as rain and snow, such as to preserve the integrity of the outer layer 22 when exposed to such atmospheric agents.

Figure 2:
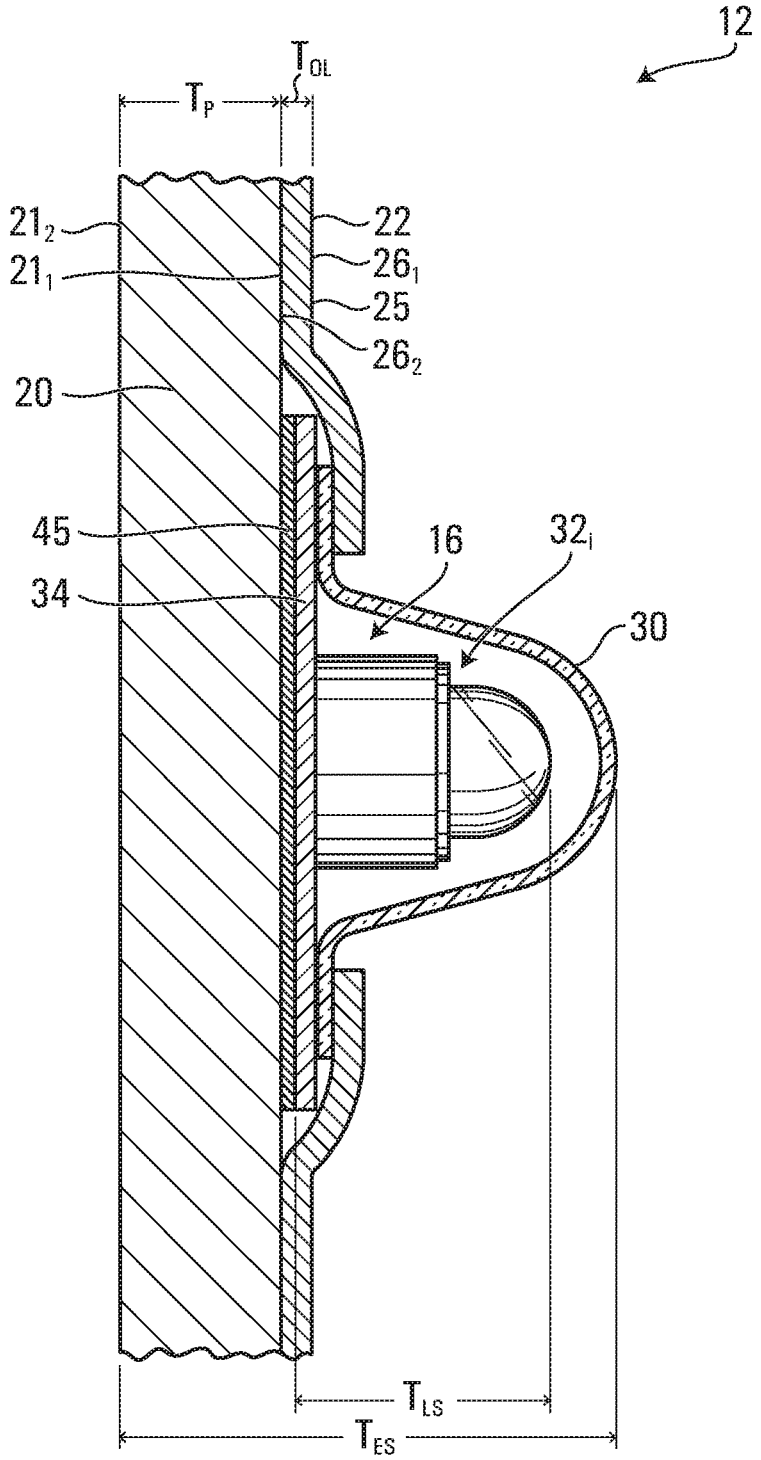
FIG. 2 is partial cross-sectional view of the light-emitting sign depicted in FIG. 1.
Figure 3:
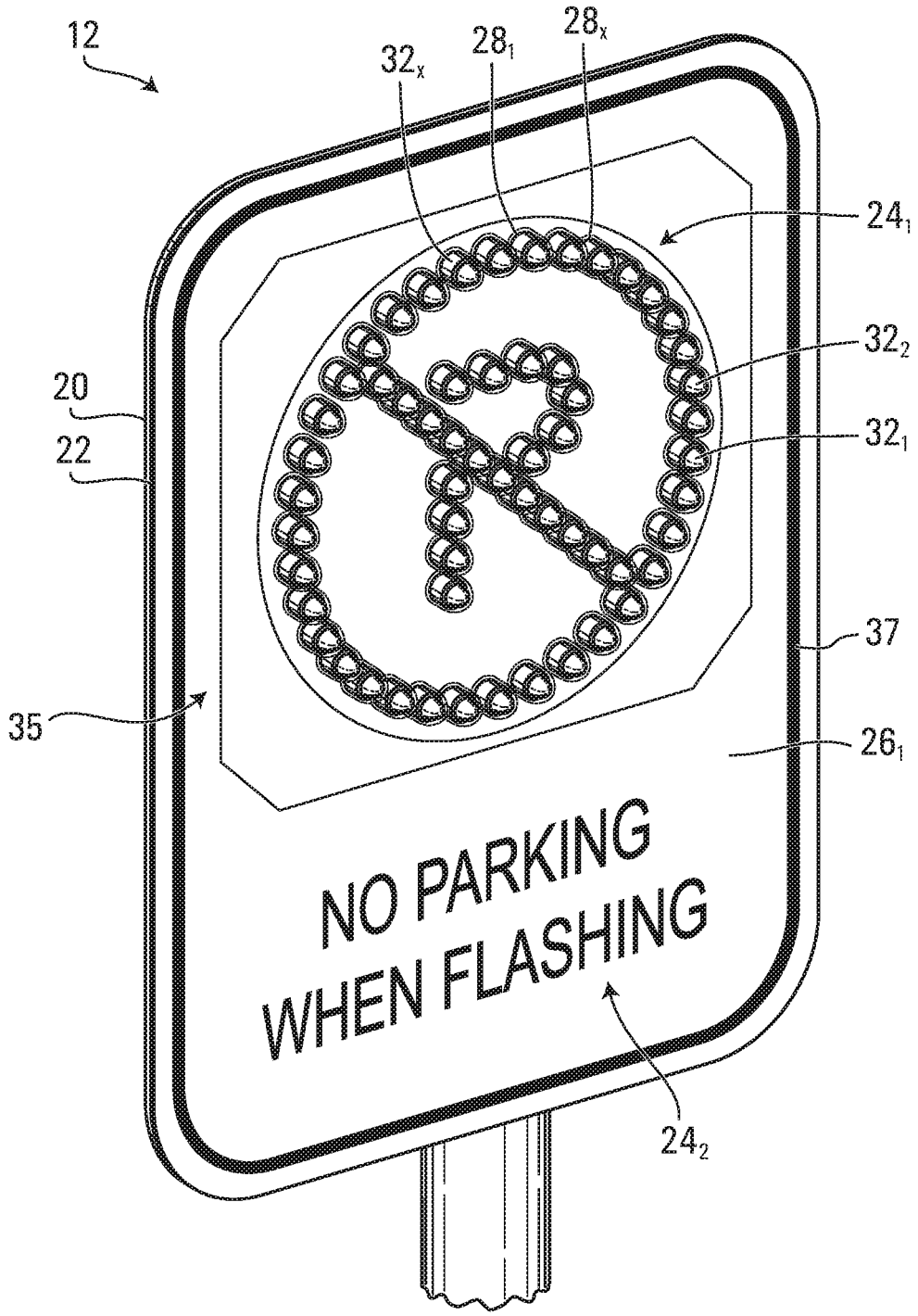
FIG. 3 is a perspective view of the light-emitting sign.

As shown in FIG. 2, the outer layer 22 comprises a front surface $\mathbf{26}_1$ and a back surface $\mathbf{26}_2$. The front surface $\mathbf{26}_1$ of the outer layer 22 faces away from the front surface $\mathbf{21}_1$ of the panel 20 and conveys the text $\mathbf{24}_2$ to the vehicles' users. The back surface $\mathbf{26}_2$ of the outer layer 22 faces towards the front surface $\mathbf{21}_1$ of the panel 20. In this example, the back surface $\mathbf{26}_2$ of the outer layer 22 is bonded to at least part of the front surface $\mathbf{21}_1$ of the panel 20. For instance, the outer layer 22 may be laminated onto the panel 20 and over the light source 16. More particularly, in this example, the back surface $\mathbf{26}_2$ of the outer layer 22 is adhesively bonded to the front surface $\mathbf{21}_1$ of the panel 20 using, for example, an adhesive film, an adhesive liner or glue.

In this embodiment, the outer layer 22 is affixed to the panel 20 to sandwich and seal at least part of the light source 16 between the outer layer 22 and the panel 20. More particularly, in this embodiment, the outer layer 22 has a shape such that at least part of the outer layer 22 abuts with at least part of the panel 20 while at least part of the light source 16 is sandwiched between the outer layer 22 and the panel 20. In this implementation, a perimeter of the outer layer 22 abuts with a perimeter of the panel 20 when the outer layer 22 is disposed onto the panel 20.

The outer layer 22 has a thickness $T_{OL}$ from the front surface $\mathbf{26}_1$ to the back surface $\mathbf{26}_2$ of the outer layer 22. In this example, the thickness $T_{OL}$ of the outer layer 22 is significantly less than the thickness $T_P$ of the panel 20. For instance, in some embodiments, the thickness $T_{OL}$ of the outer layer 22 may be less than half the thickness $T_P$ of the panel 20, in some cases less than one-third of the thickness $T_P$ of the panel 20, in some cases less than one-quarter of the thickness $T_P$ of the panel 20, in some cases less than one-fifth of the thickness $T_P$ of the panel 20, and in some cases even less (e.g., one-tenth of the thickness $T_P$ of the panel 20). For example, in some embodiments, the thickness $T_{OL}$ of the outer layer 22 may be no more than 3 millimeters, in some cases no more than 2 millimeters, and in some cases no more than 1 millimeter, in some cases no more than 0.5 millimeters, and in some cases even less (e.g., 0.1 millimeters). For instance, in some embodiments, the thickness $T_{OL}$ of the outer layer 22 may be between 2 millimetres and 3 millimetres, in some cases between 1 millimeter and 2 millimeters, and in some cases between 0.1 millimeters and 1 millimeter.

In this embodiment, the outer layer 22 conveys at least part of the information to the vehicles' users. Notably, in this case, the outer layer 22 comprises the text $\mathbf{24}_2$. The outer layer 22 may comprise any other graphics or other informational elements in other embodiment, such as, for example, symbols, geometric designs, text, images, and color.

Figure 13:
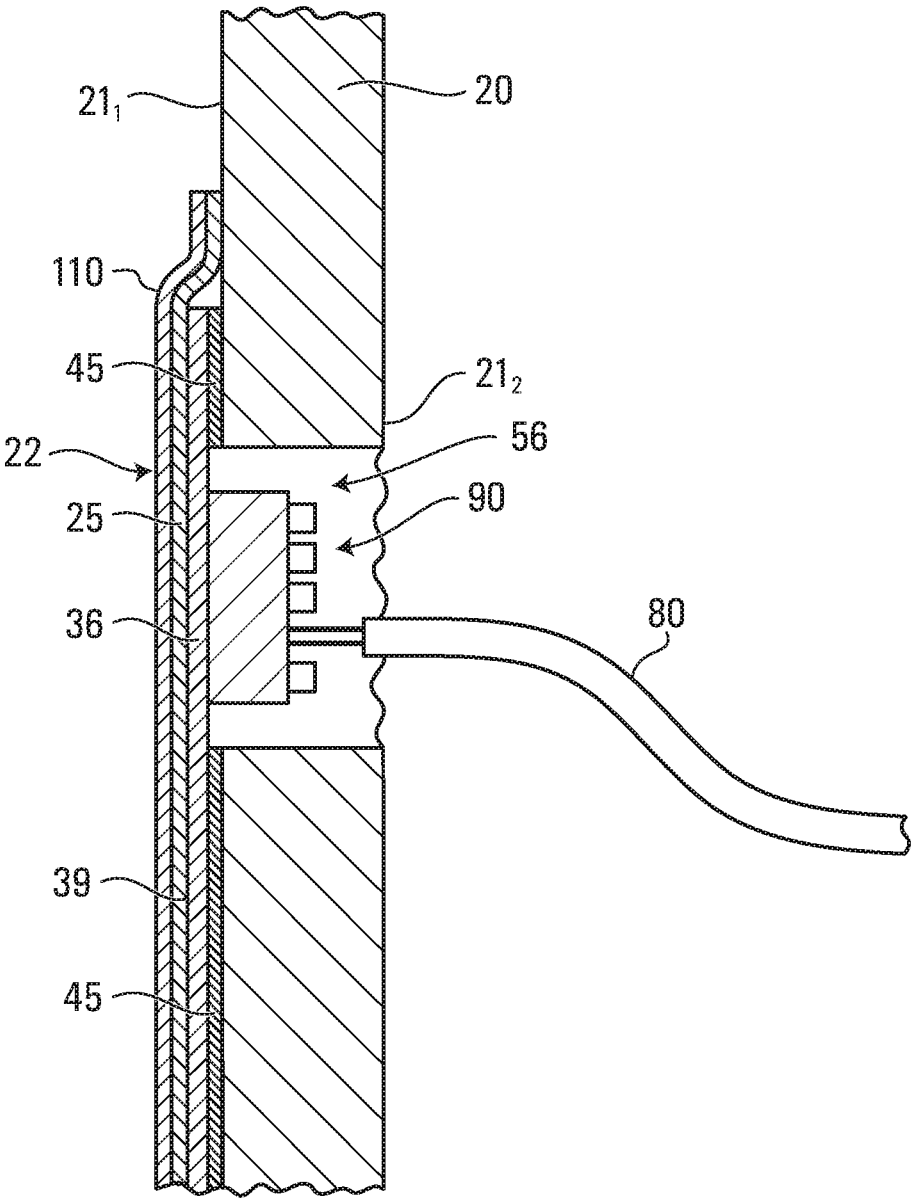
FIG. 13 is a partial cross-sectional view of the light-emitting sign showing a connector of the light-emitting sign.

In some embodiments, as shown in FIG. 13, the outer layer 22 may also comprise a protective film 110 disposed onto the film 25. The protective film 110 may be substantially transparent to allow the information of the outer layer 22 to remain visible to the vehicles' users. The protective film 110 may also be reflective to allow reflection of the light being shed onto the light-emitting sign 12. The protective film 110 may comprise a plastic material (e.g., polycarbonate) and has a relatively small thickness. For example, the thickness of the protective film 110 may be between 0.05 millimeters and 0.2 millimeters. The protective film 110 may be adhesively affixed to the film 25 (e.g., via an adhesive liner of the protective film 110).

In this example of implementation, the outer layer 22 comprises a plurality of openings $\mathbf{28}_1$-$\mathbf{28}_x$ to accommodate at least part of the light source 16, as will be discussed later. The openings $\mathbf{28}_1$-$\mathbf{28}_x$ are disposed on the outer layer 22 such as to convey at least part of the information of the light-emitting traffic sign 12. The openings $\mathbf{28}_1$-$\mathbf{28}_x$ may be formed in any suitable way, such as by cutting, punching or drilling. For example, the openings $\mathbf{28}_1$-$\mathbf{28}_x$ may be formed by a blade controlled via a computer numerical control (CNC) machine.

The outer layer 22 may be implemented in any other suitable way in other embodiments (e.g., may have any other shape and/or comprise any other material).

Figure 4:
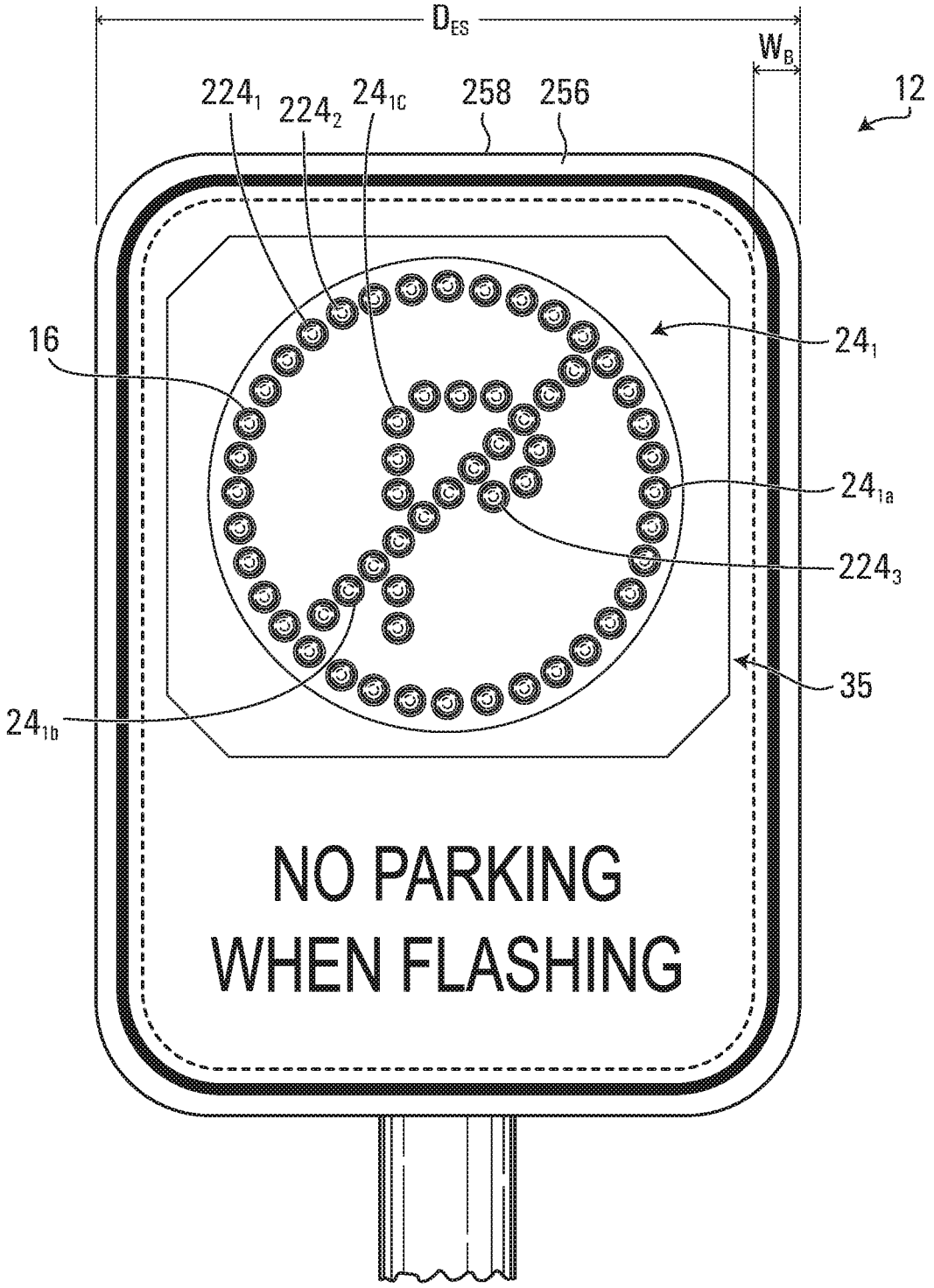
FIG. 4 is a front view of the light-emitting traffic sign.

The light source 16 is configured to emit light to assist in conveying the information provided by the light-emitting traffic sign 12 to the vehicles' users. Notably, in this embodiment, as shown in FIG. 4, the light source 16 is arranged such that the light defines the symbol $\mathbf{24}_1$ of the light-emitting traffic sign 12. More particularly, the light source 16 defines at least a majority (i.e., a majority or an entirety) of the symbol $\mathbf{24}_1$ which is the "no parking" symbol implemented by the circle $\mathbf{24}_{1a}$ with the diagonal line $\mathbf{24}_{1b}$ surrounding the "P" character $\mathbf{24}_{1c}$ used to indicate that no parking is permitted. In this example, the openings $\mathbf{28}_1$-$\mathbf{28}_x$ of the outer layer 22 are disposed in accordance with the circle $\mathbf{24}_{1a}$, the diagonal line $\mathbf{24}_{1b}$ and the pictogram $\mathbf{24}_{1c}$ to accommodate the light source 16 and cause the symbol $\mathbf{24}_1$ to be illuminated and to diffuse light outwardly from the front surface $\mathbf{18}_1$ of the light-emitting traffic sign 12.

In this embodiment, the text $\mathbf{24}_2$, a geometric shape 35 and a line 37 on the front surface $\mathbf{26}_1$ of the outer layer 22 are not defined by the light emitted by the light source 16 and thus no openings are provided to accommodate the light source 16 for this purpose. Alternatively, in other instances, the text $\mathbf{24}_2$ "NO PARKING WHEN FLASHING" may be defined by the light source 16. In these instances, the light source 16 is arranged to define all the letters of the text $\mathbf{24}_2$ and openings $\mathbf{28}_1$-$\mathbf{28}_x$ are provided on the outer layer 22 to accommodate the light source 16 defining the letters of the text $\mathbf{24}_2$.

Figure 5:
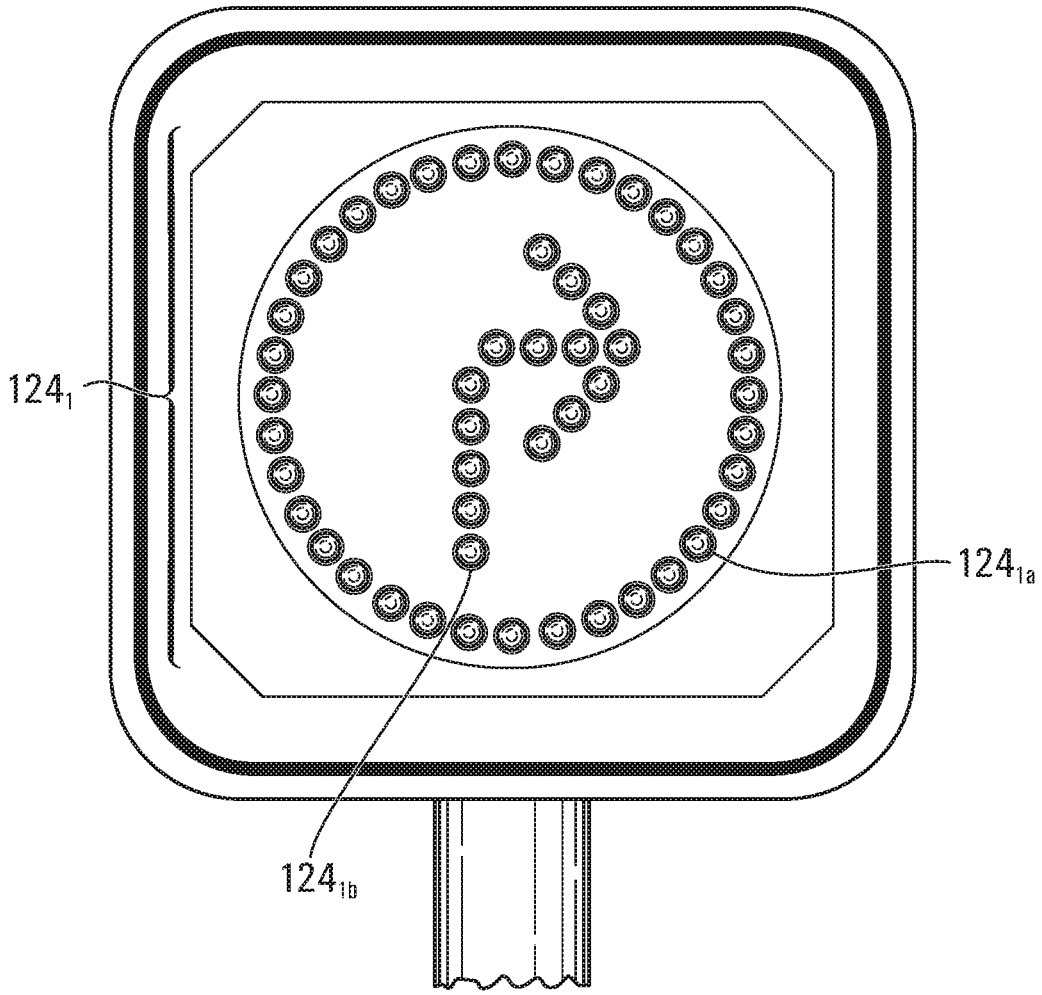
FIG. 5 is a front view of an example of an embodiment of the light-emitting sign in which the light-emitting sign is a different sort of traffic sign.

The light emitted by the light source 16 may define at least part of any other informational element in other embodiments. For example, in some embodiments, as shown in FIG. 5, the light may define at least part of a symbol $\mathbf{124}_1$ that is a permissive symbol, which refers to a "yes" symbol implemented as a circle $\mathbf{124}_{1a}$ surrounding a character or pictogram $\mathbf{124}_{1b}$ used to indicate an action is permitted, in this case an arrow curving right to indicate that a right turn is permitted. The light source 16 may be arranged such that the light emitted by the light source 16 defines at least part of a plurality of symbols such as the symbol $\mathbf{124}_1$.

The light source 16 may be arranged such that the light is emitted from light-emitting points $\mathbf{224}_a$-$\mathbf{224}_s$ distributed over a significant area of the light-emitting traffic sign 12.

For example, in this embodiment, the light source 16 is arranged such that at least part of the light is emitted remotely from a border 256 of the light-emitting traffic sign 12. The border 256 of the light-emitting traffic sign 12 is a band that extends around a periphery 258 of the light-emitting traffic sign 12 and has a width $W_B$ corresponding to one-tenth of a width $D_{ES}$ of the light-emitting traffic sign 12, which is a horizontal dimension of the light-emitting traffic sign 12.

For instance, in this embodiment, respective ones of the light-emitting points $\mathbf{224}_a$-$\mathbf{224}_5$ are spaced from the periphery 258 of the light-emitting traffic sign 12 by at least one-tenth, in some cases at least one-quarter, in some cases at least one-third, and in some cases an even greater proportion of the width $D_{ES}$ of the light-emitting sign 12.

Figure 6:
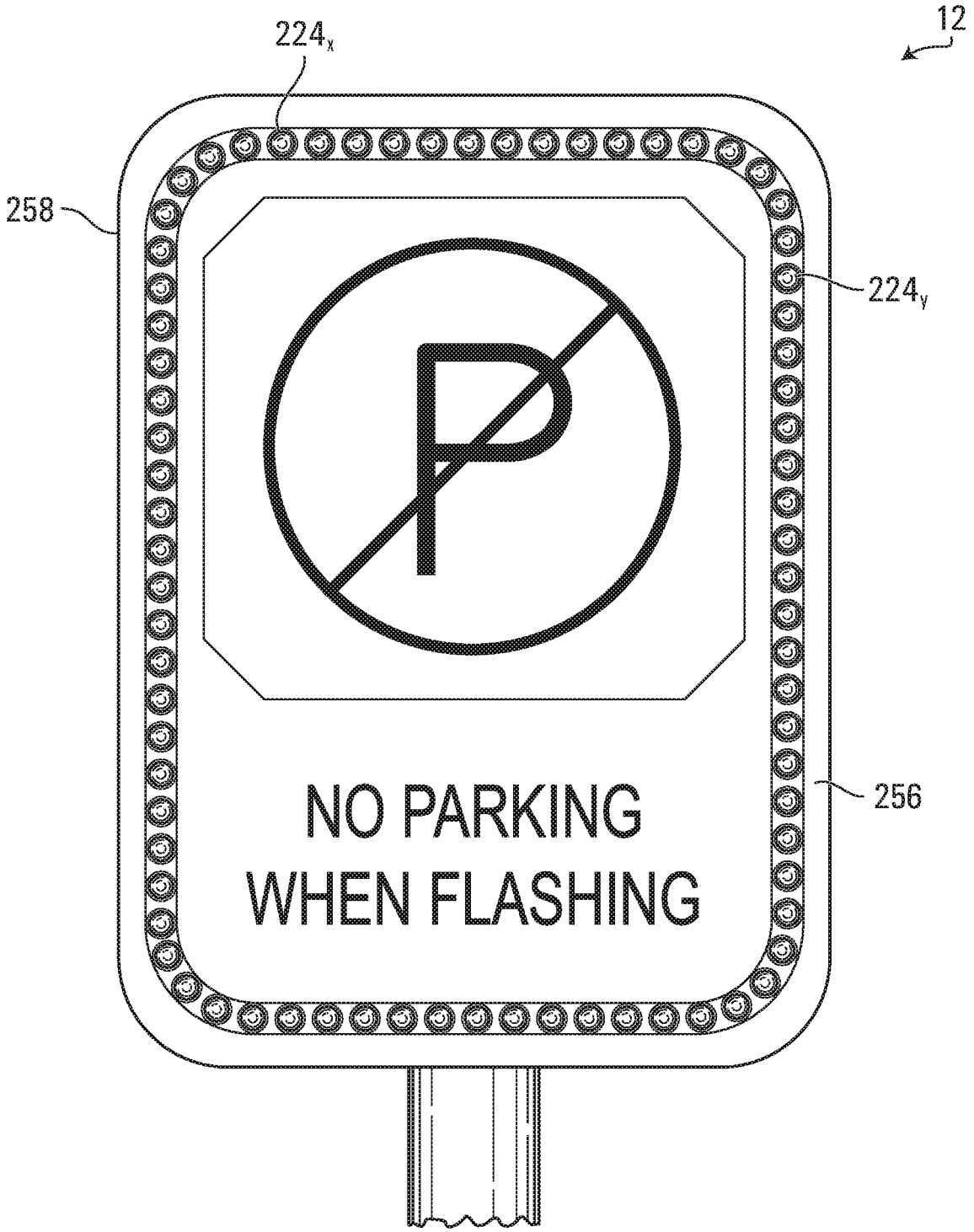
FIG. 6 is a front view of an example of an embodiment of the light-emitting sign in which light-emitting points of a light source of the light-emitting sign are disposed at a border thereof.

In some embodiments, as shown in FIG. 6, the light-emitting points $\mathbf{224}_a$-$\mathbf{224}_s$ may be disposed at the border 256 of the light-emitting traffic sign 12.

Figure 7:
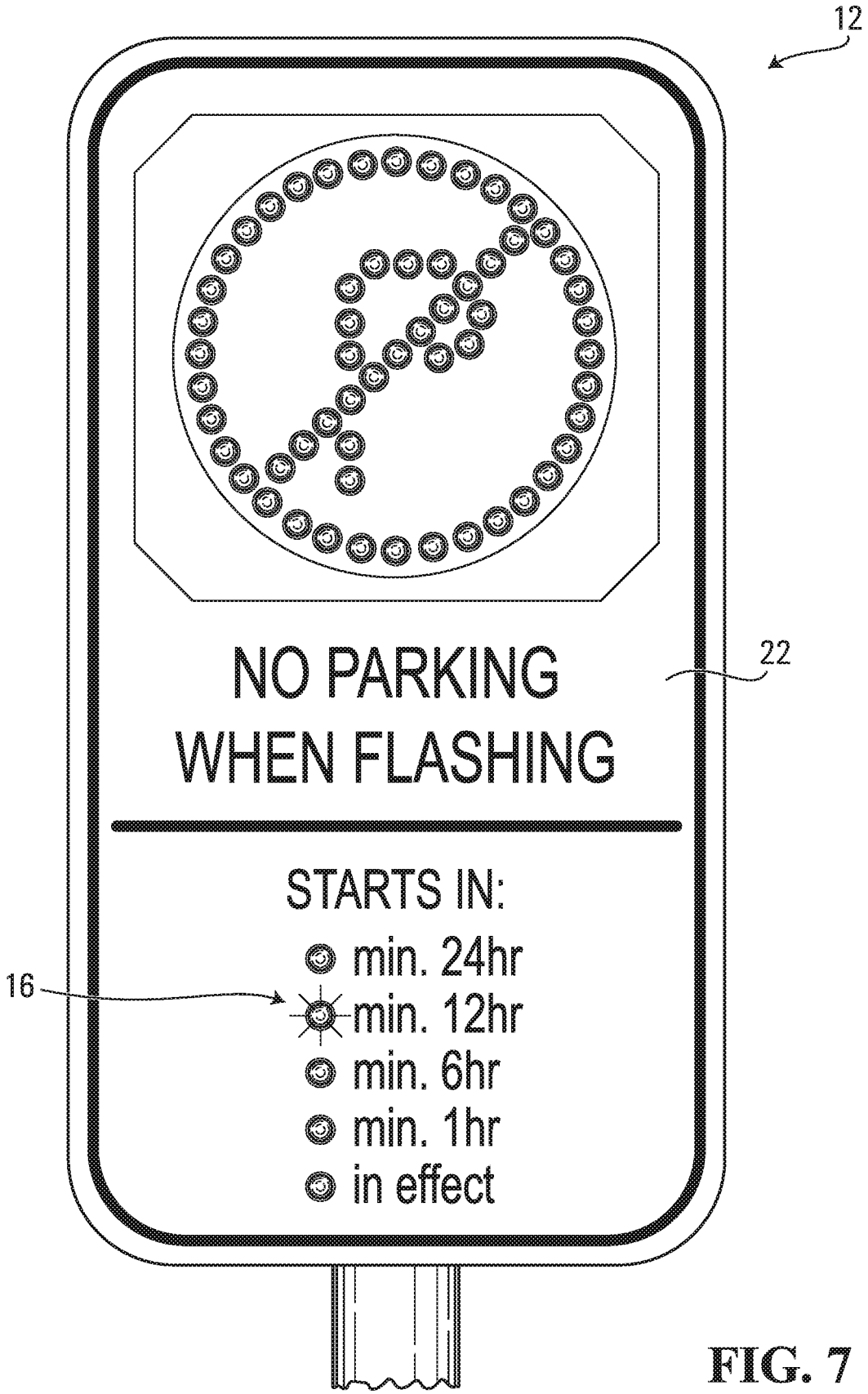
FIG. 7 is a front view of an example of an embodiment of the light-emitting sign in which the light source of the light-emitting sign directs the attention of a user to a subsent of information on an outer layer of the light-emitting sign.

In some embodiments, the light emitted by the light source 16 may assist in directing the attention of the vehicles' users to a subset of the information on the outer layer 22. For example, as shown in FIG. 7, the light may inform the users that a certain condition conveyed by the information is in effect (i.e., "no parking" will be in effect in minimum 12 hours), whereas another condition conveyed by the information is not in effect (i.e., "no parking" in minimum 24 hours, in minimum 6 hours, in minimum 1 hour, or in effect). The light source 16 is arranged such that it may interchangeably identify a specific subset of the information.

The light emitted by the light source 16 may be of any suitable color. For example, it may be of various colors to facilitate communication of more complex information and/or to enhance the capability of the light-emitting traffic sign 12 to attract attention. For example, the light may be red to indicate that a certain action is prohibited, or the light may be orange to inform to user to exercise caution, or the light may be green to indicate that a certain action is permitted. Other colors may be used to provide any other information.

Figure 8:
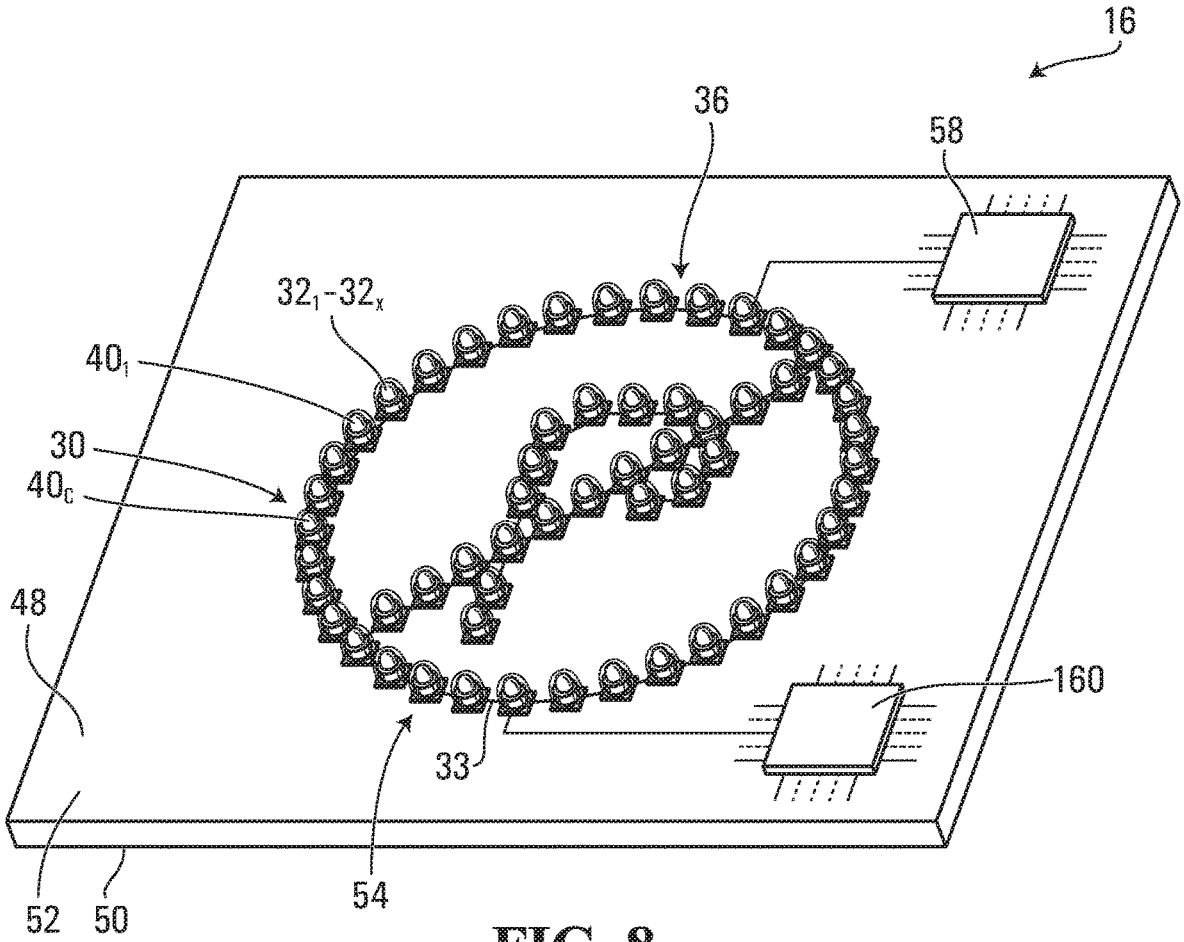
FIG. 8 is a perspective view of the light source of the present light-emitting sign of FIG. 1.
Figure 9:
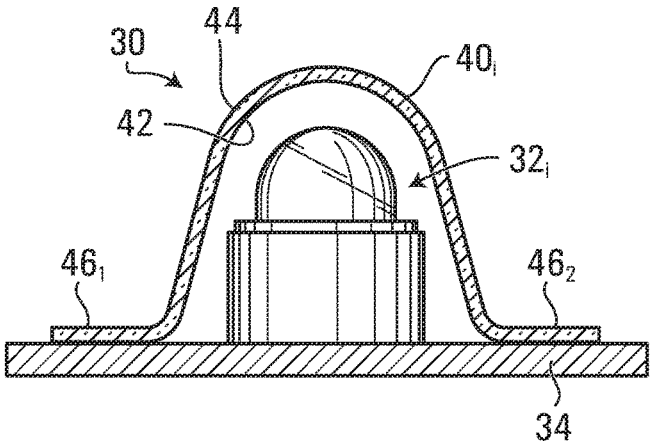
FIG. 9 is a partial cross-sectional view of the light source of FIG. 8.
Figure 10:
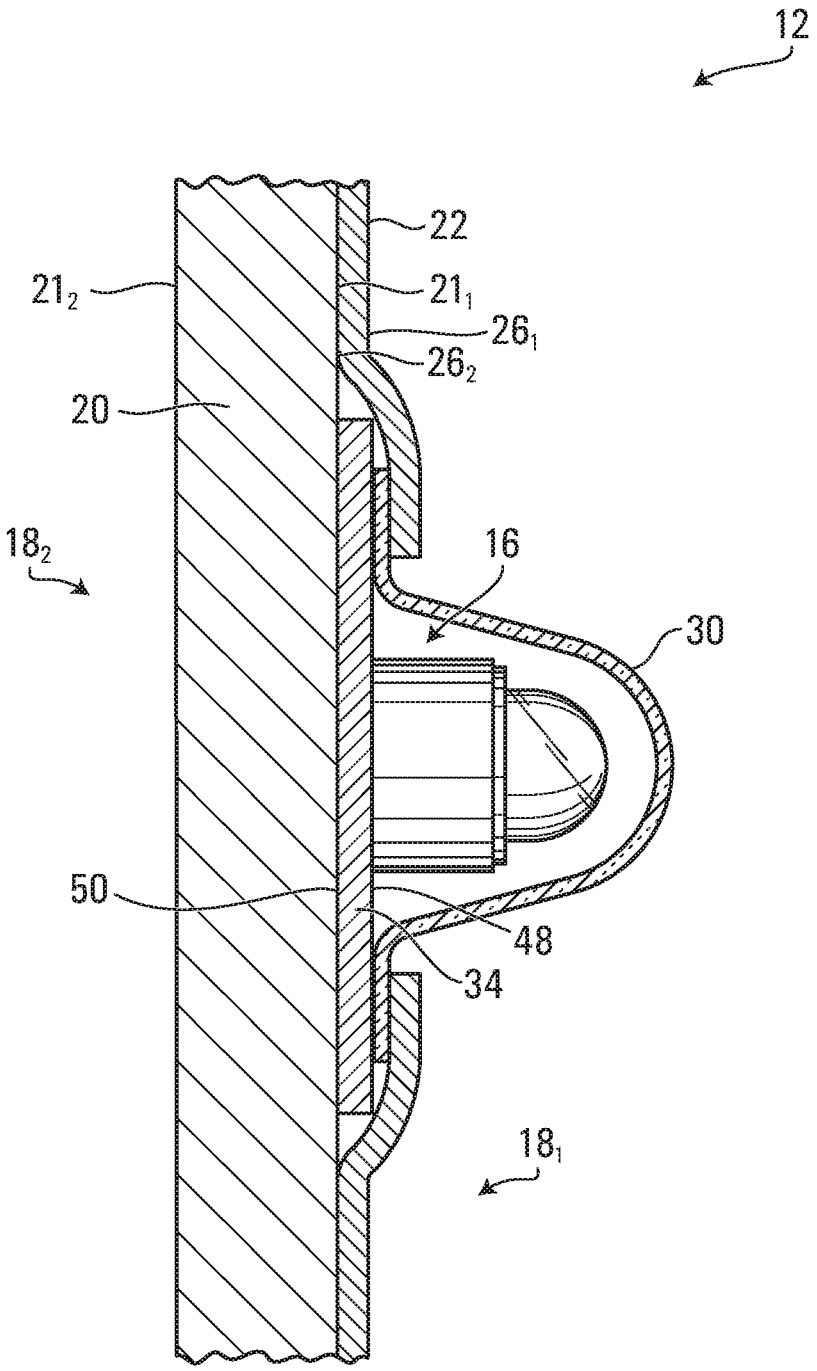
FIG. 10 is a partial cross-sectional view of the light-emitting sign in accordance with an embodiment in which a panel of the light-emitting sign comprises an insulator material.

In this embodiment, as seen in FIG. 8, the light source 16 comprises a plurality of light emitters $\mathbf{32}_1$-$\mathbf{32}_x$ and a base 34 supporting and delivering power to the light emitters $\mathbf{32}_1$-$\mathbf{32}_x$.

Each of the light emitters $\mathbf{32}_1$-$\mathbf{32}_x$ is configured to emit light when powered. As such, the light emitters $\mathbf{32}_1$-$\mathbf{32}_x$ may comprise the light-emitting points $\mathbf{224}_a$-$\mathbf{224}_s$ of the light source 16. Any suitable light-emitting device may be used to implement the light emitters $\mathbf{32}_1$-$\mathbf{32}_x$.

In this embodiment, the light emitters $\mathbf{32}_1$-$\mathbf{32}_x$ are light-emitting diodes (LEDs). Any suitable LED technology may be used. For example, in some embodiments, the LEDs may use between approximately 10 milliamps and 100 milliamps of current and have an output intensity, measured in millicandella, of at least 3000 millicandella, at least 4000 millicandella, at least 5000 millicandella, at least 7000 millicandella, at least 9000 millicandella or at least 10000 millicandella. The LEDs $\mathbf{32}_1$-$\mathbf{32}_x$ may use any other suitable power and/or may output light with any other intensity in other embodiments.

In some instances, the light emitters $\mathbf{32}_1$-$\mathbf{32}_x$ may have a radiation pattern having a radiation angle A that may be optimized for conditions in which the light-emitting traffic sign 12 is employed. For example, in some embodiments, the radiation angle A may be no more than 180 degrees, in some cases no more than 120 degrees, in some cases no more than 60 degrees, in some cases no more than 45 degrees, in some cases no more than 30 degrees, and in some cases even less (e.g., 15 degrees). Since the light-emitting traffic sign 12 is to be pointed towards oncoming traffic, the light emitted by the light emitters $\mathbf{32}_1$-$\mathbf{32}_x$ may thereby be directed towards oncoming traffic so as to avoid or reduce being be seen by traffic on side streets, thus minimizing the need for shielding the light emitted from the light emitters $\mathbf{32}_1$-$\mathbf{32}_x$.

The light emitters $\mathbf{32}_1$-$\mathbf{32}_x$ may be implemented by other types of light emitters besides LEDs in other embodiments, such as, for example, fluorescent lamps, neon lamps and halogen lamps.

Any suitable number of light emitters may be used. For instance, the number of light emitters $\mathbf{32}_1$-$\mathbf{32}_x$ may be defined by, for example, the size of the light-emitting traffic sign 12, the number and size of the informational elements conveyed by light, the spacing between the light emitters $\mathbf{32}_1$-$\mathbf{32}_x$, the type of light emitters $\mathbf{32}_1$-$\mathbf{32}_x$, the size of the light emitters $\mathbf{32}_1$-$\mathbf{32}_x$, and/or the intensity of the light emitters $\mathbf{32}_1$-$\mathbf{32}_x$.

For example, in some embodiments, the light emitters $\mathbf{32}_1$-$\mathbf{32}_x$ may include at least ten light emitters, in some cases at least twenty light emitters, in some cases at least thirty light emitters, in some cases at least forty light emitters, in some cases at least fifty light emitters, and in some cases even more.

In this embodiment, the light-emitting traffic sign 12 comprises a light-passing cover 30 that overlays the light source 16 to protect it and allows the light emitted by the light source 12 to pass through the light-passing cover 30. The light-passing cover 30 may prevent atmospheric agents (e.g., rain, snow, wind, dust, etc.) from entering in contact with the light emitters $\mathbf{32}_1$-$\mathbf{32}_x$ and/or with the base 34. The light-passing cover 30 is substantially transparent and allows passing of the light.

In this embodiment, the light-passing cover 30 partially extends between the panel 20 and the outer layer 22 (i.e., a portion of the light-passing cover 30 is disposed beneath the outer layer 22). More particularly, the light-passing cover 30 partially extends between the front surface $\mathbf{21}_1$ of the panel 20 and the back surface $\mathbf{26}_2$ of the outer layer 22.

The light-passing cover 30 may be implemented in any suitable way. In this embodiment, the light-passing cover 30 comprises a plurality of light-passing covering elements $\mathbf{40}_1$-$\mathbf{40}_c$ that overlie respective ones of the light emitters $\mathbf{32}_1$-$\mathbf{32}_x$. In this case, the light-passing covering elements $\mathbf{40}_1$-$\mathbf{40}_c$ are individually and separately disposed onto the respective ones of the light emitters $\mathbf{32}_1$-$\mathbf{32}_x$.

More particularly, in this embodiment, each light-passing covering element $\mathbf{40}_i$ comprises polymeric material, such as for example, polyvinyl chloride (PVC). In other embodiments, the light-passing covering element $\mathbf{40}_i$ may comprise acrylic, polycarbonate (PC), polyethylene terephthalate (PET), glass, or any other suitable material. The material of the light-passing covering element $\mathbf{40}_i$ may have anti-UV properties. The light-passing covering element $\mathbf{40}_i$ comprises an inner concave surface 42, an outer convex surface 44, and portions $\mathbf{46}_1$, $\mathbf{46}_2$ adjacent the light emitter $\mathbf{32}_i$ that it overlies. The inner concave surface 42 accommodates the light emitter $\mathbf{32}_i$ when the light-passing covering element $\mathbf{40}_i$ is overlaid on the light emitter $\mathbf{32}_i$ and the portions $\mathbf{46}_1$, $\mathbf{46}_2$ extend on at least a part of a surface of the base 34 surrounding the light emitter $\mathbf{32}_i$ to seal the light emitter $\mathbf{32}_i$ and the base 34.

In this embodiment, the light-passing covering element $\mathbf{40}_i$ projects outwardly beyond the outer layer 22, specifically, beyond the front surface $\mathbf{26}_1$ of the outer layer 22, whereas the extending portions $\mathbf{46}_1$, $\mathbf{46}_2$ are disposed between the front surface $\mathbf{21}_1$ of the panel and the back surface $\mathbf{26}_2$ of the outer layer 22 (i.e., a portion of the light-passing covering element $\mathbf{40}_i$ is disposed beneath the outer layer 22).

While in this embodiment, individual light-passing covering elements are used for each of the light emitters $\mathbf{32}_1$-$\mathbf{32}_x$, in other implementations, the light-passing cover 30 may be a unitary piece of material comprising a plurality of light-passing covering elements $\mathbf{40}_1$-$\mathbf{40}_c$, wherein each one of the plurality of light-passing covering elements $\mathbf{40}_1$-$\mathbf{40}_c$ overlays one of the light emitters $\mathbf{32}_1$-$\mathbf{32}_x$. As will be described in more detail below, in this implementation, the plurality of light-passing covering elements $\mathbf{40}_1$-$\mathbf{40}_c$ defines a path that corresponds to a path of illumination 38 of the base 34 such as to overlay the light emitters $\mathbf{32}_1$-$\mathbf{32}_x$ of the base 34.

The base 34 of the light source 16 comprises a front surface 48 and a back surface 50 and supports and delivers power to the light emitters $\mathbf{32}_1$-$\mathbf{32}_x$. In this embodiment, the base 34 comprises a printed circuit board (PCB) 36. Since it is used for display purposes, in this example, the PCB 36 may be referred to as a "display" board or card. The PCB 36 is disposed between the panel 20 and the outer layer 22. More particularly, the PCB 36 is disposed between the front surface $\mathbf{21}_1$ of the panel 20 and the back surface $\mathbf{26}_2$ of the outer layer 22.

The PCB 36 comprises a substrate 52 and an electrical circuit 54 supported by the substrate 52 and configured to deliver power to the light emitters $\mathbf{32}_1$-$\mathbf{32}_x$. The substrate 52 may be thin and flexible and may be composed of any suitable material, such as, for example, fiber glass and/or plastic. The electrical circuit 54 comprises conductors 33 extending on the PCB 36 and connected to the light emitters $\mathbf{32}_1$-$\mathbf{32}_x$.

In this embodiment, the light emitters $\mathbf{32}_1$-$\mathbf{32}_x$ are mounted on a side of the PCB 36 to define the path of illumination 38. The light emitters $\mathbf{32}_1$-$\mathbf{32}_x$ may be mounted to the PCB 36 in any suitable way, such as by being soldered or glued to the surface of the PCB 36. For example, in embodiments where the light emitters $\mathbf{32}_1$-$\mathbf{32}_x$ are LEDs, the LEDs may be "surface mounted" LEDs that do not have wires but rather have small metallic contacts that can be soldered directly to the PCB 36. The path of illumination 38 outlines the perimeter of the symbol $\mathbf{24}_1$ to be defined by light. Notably, the path of illumination 38 outlines the circle $\mathbf{24}_{1a}$, the diagonal $\mathbf{24}_{1b}$ and the character $\mathbf{24}_{1c}$.

In some embodiments, a thickness $T_{PCB}$ of the PCB 36 may be no more than 2 millimeters, in some cases no more than 1 millimeter, in some cases no more than 0.5 millimeters and in some cases even less (e.g., 0.4, 0.3 millimeters).

Figure 12A:
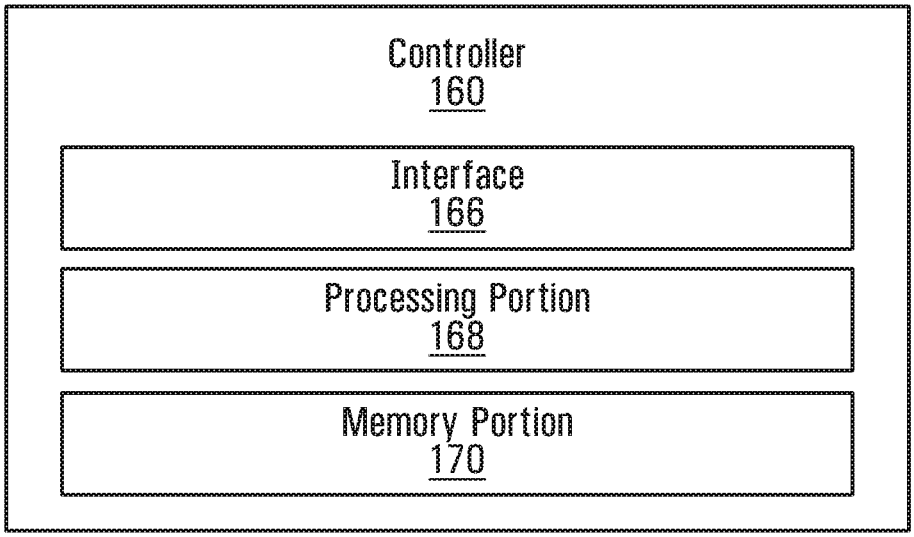
FIG. 12A is a block diagram representation of an example of an embodiment of a controller of a printed circuit board of the light source.

The PCB 36 may comprise a controller 160 to control the light emitters $\mathbf{32}_1$-$\mathbf{32}_x$. As shown in FIG. 12A, the controller 160 may comprise an interface 166, a processing portion 168, and a memory portion 170, which are implemented by suitable hardware and/or software. The interface 166 comprises one or more inputs and outputs allowing the controller 160 to receive input signals from and send output signals to other components to which the controller 160 is connected (i.e., directly or indirectly connected). The processing portion 168 comprises one or more processors for performing processing operations that implement functionality of the controller 160. A processor of the processing portion 168 may be a general-purpose processor executing program code stored in the memory portion 170. Alternatively, a processor of the processing portion 168 may be a specific-purpose processor comprising one or more preprogrammed hardware or firmware elements (e.g., application-specific integrated circuits (ASICs), electrically erasable programmable read-only memories (EEPROMs), etc.) or other related elements. The memory portion 170 comprises one or more memories for storing program code executed by the processing portion 168 and/or data used during operation of the processing portion 168. A memory of the memory portion 170 may be a semiconductor medium (including, e.g., a solid-state memory), a magnetic storage medium, an optical storage medium, and/or any other suitable type of memory. A memory of the memory portion 170 may be read-only memory (ROM) and/or random-access memory (RAM), for example.

In this embodiment, the light-emitting sign 12 comprises an electrical insulator 45 disposed between the light source 16 and the panel 20. The electrical insulator 45 prevents electric conduction between the panel 20 and the light source 16. More particularly, in this embodiment, the electrical insulator 45 is disposed between the base 34 of the light source 16 and the panel 20. Specifically, in this example, the electrical insulator 45 is disposed between the PCB 36 and the panel 20. The electrical insulator 45 may be implemented in any suitable way. For instance, in some embodiments, the electrical insulator 45 may comprise fabric and an adhesive layer on the fabric. For example, the electrical insulator 45 may consist of double-sided tape.

The light-emitting traffic sign 12 may be considerably thin. Notably, in some embodiments, the light-emitting traffic sign 12 may be comparably thin to a standard non-light-emitting traffic sign.

A thickness $T_{ES}$ of the light-emitting traffic sign 12 may thus be small. For instance, in some embodiments, the thickness $T_{ES}$ of the light-emitting traffic sign 12 may be no more than 25 millimeters, in some cases no more than 20 millimeters, in some cases no more than 15 millimeters, in some cases no more than 10 millimeters, and in some cases even less (e.g., 8 millimeters).

In some embodiments, the thickness $T_{LS}$ of the light source 16 may correspond to at least a majority of the thickness $T_{ES}$ of the light-emitting traffic sign 12. For instance, in some cases, a ratio of the thickness $T_{LS}$ of the light source 16 over the thickness $T_{ES}$ of the light-emitting traffic sign 12 may be at least 0.4, in some cases at least 0.5, in some cases at least 0.6, in some cases at least 0.7, in some cases at least 0.8, in some cases at least 0.9 and in some cases even more. This ratio may have any other suitable value in other embodiments. Accordingly, in this example, the thickness $T_{LS}$ of the light source 16 may be equal to or greater than a sum of the thickness $T_P$ of the panel 20 and the thickness $T_{OL}$ of the outer layer 22 ($T_P$+$T_{OL}$) (i.e., a dimension of the light-emitting traffic sign 12 from the back surface $\mathbf{21}_2$ of the panel 20 to the front surface $\mathbf{26}_1$ of the outer layer 22). For example, in some cases, the dimension of the light-emitting traffic sign 12 from the back surface $\mathbf{21}_2$ of the panel 20 to the front surface $\mathbf{26}_1$ of the outer layer 22 may be no more than 20 millimeters, in some cases no more than 15 millimeters, in some cases no more than 10 millimeters, in some cases no more than 5 millimeters, and in some cases even less (e.g., 4 millimeters).

Moreover, in some cases, a ratio of the thickness $T_{LS}$ of the light source 16 over the thickness $T_P$ of the panel 20 may be no more than 4, in some cases no more than 3, in some cases no more than 2, in some cases no more than 1.5 and in some cases even less.

The panel 20 may be relatively thin. For instance, a ratio of the thickness $T_{PCB}$ of the printed circuit board 36 over the thickness $T_P$ of the panel 20 may be no more than 0.4, in some cases no more than 0.3, in some cases no more than 0.2, in some cases no more than 0.15, in some cases no more than 0.1, and in some cases even less.

Moreover, in some cases, the thickness $T_P$ of the panel 20 may correspond to at least one-third of the thickness $T_{ES}$ of the light-emitting traffic sign 12. In some cases, the thickness $T_P$ of the panel 20 may correspond to at least a majority of the thickness $T_{ES}$ of the light-emitting traffic sign 12. For example, the the thickness $T_P$ of the panel 20 may correspond to at least three-quarters of the thickness $T_{ES}$ of the light-emitting traffic sign 12. For instance, in some cases a ratio of the thickness $T_{ES}$ of the light-emitting traffic sign 12 over the thickness $T_P$ of the panel 20 may be no more than 4, in some cases no more than 3, in some cases no more than 2, and in some cases even less.

Figure 11:
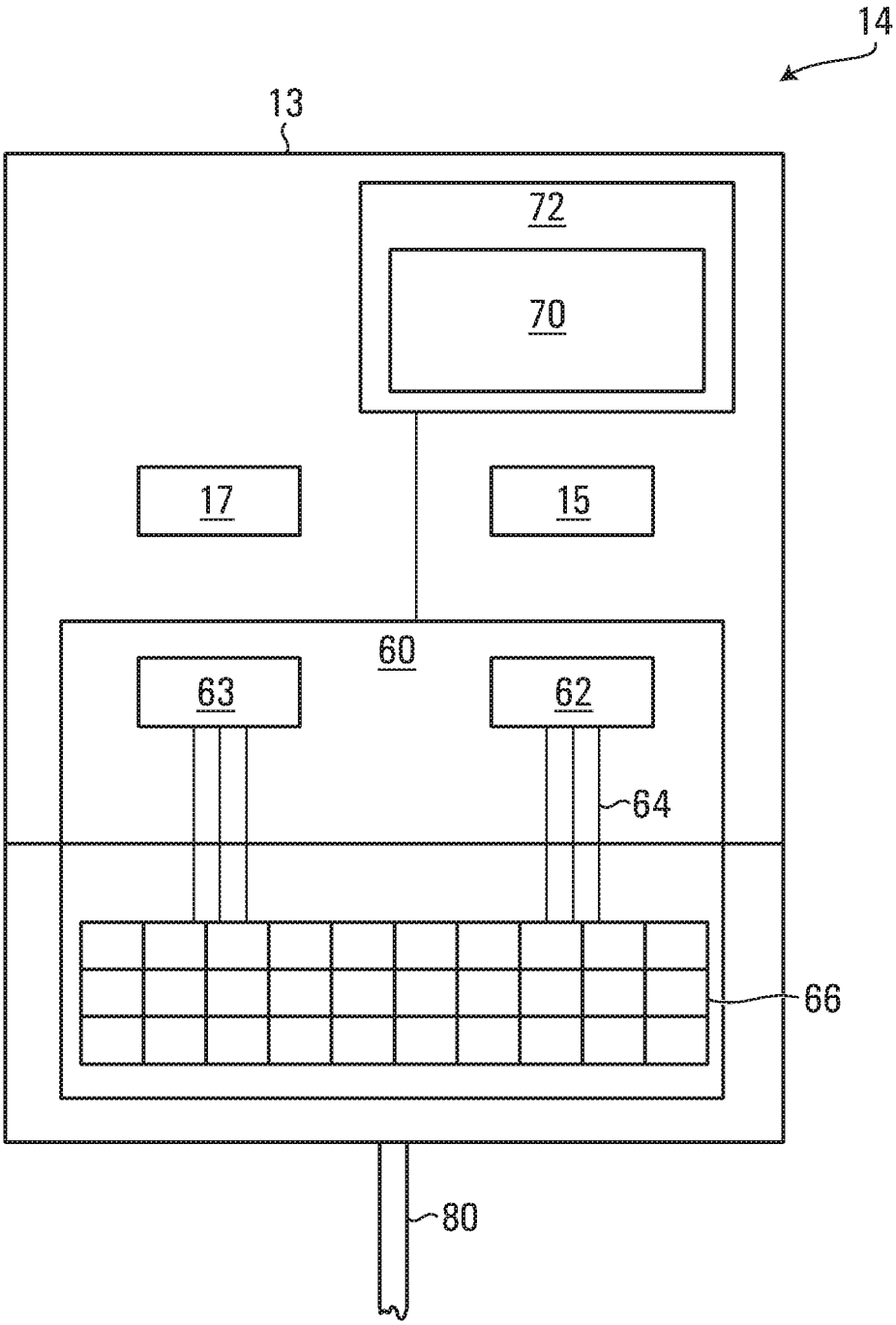
FIG. 11 is a schematic representation of the external device of the light-emitting sign apparatus of FIG. 1.

The external device 14 is connected to the light-emitting traffic sign 12 to operate the light-emitting traffic sign 12. In this embodiment, the external device 14 is configured to power and control the light source 16 of the light-emitting traffic sign 12. To that end, as shown in FIG. 11, the external device 14 comprises a power supply 60 and a controller 70. The external device 14 is connected to the light-emitting traffic sign 12 via a cable 80. In this embodiment, the external device 14 comprises a housing 13 for housing one or more components of the external device 14, including at least part of the controller 70 and at least part of the power supply 60.

The power supply 60 is configured to power the light-emitting traffic sign 12. In this embodiment, the power supply 60 comprises a battery 62, another battery 63, a battery charging circuit 64, and a solar panel 66. In this example, each of the batteries 62, 63 is rechargeable. For instance, each of the batteries 62, 63 may be a rechargeable lithium battery. Any other suitable type of battery may be used.

Each of the batteries 62, 63 is electrically connected to the solar panel 66 via the battery charging circuit 64 so that the solar panel 66 can charge each of the batteries 62, 63. When sufficient ambient light is available, the solar panel 66 can thus charge the batteries 62, 63. Alternatively or in addition to the solar panel 66, in some embodiments, each of the batteries 62, 63 may be electrically connected to an external electrical power source (not shown) such as any low voltage DC power source.

The controller 70 is configured to control operation of the light-emitting traffic sign 12, including the light source 16. The controller 70 is electrically coupled to the light source 16 via the cable 80. In this embodiment, the controller 70 controls the operation of the light emitters $\mathbf{32}_1$-$\mathbf{32}_x$. For example, the controller 70 may cause one or more of the light emitters $\mathbf{32}_1$-$\mathbf{32}_x$ to be continuously lit, to be lit in a strobe-like manner, or in a flashing manner. The controller 70 may allow only a subset (or a selected group) of the light emitters $\mathbf{32}_1$-$\mathbf{32}_x$ to be lit (e.g., to illuminate a specific graphic on the light-emitting sign 12) or may allow only a specific color light emitters $\mathbf{32}_1$-$\mathbf{32}_x$ to be lit. For example, in some embodiments, the controller 70 may allow only the yellow light emitters $\mathbf{32}_1$-$\mathbf{32}_x$ to be on (caution lights) or only the red light emitters $\mathbf{32}_1$-$\mathbf{32}_x$ to be on (warning lights) or only the green light emitters $\mathbf{32}_1$-$\mathbf{32}_x$ to be on (action permitted). The controller 70 may further control the intensity of the light emitters $\mathbf{32}_1$-$\mathbf{32}_x$.

In this embodiment, the controller 70 is configured to manage the power supply 60, including use of the batteries 62, 63 and charging of these batteries by the solar panel 66. For example, in this embodiment, the controller 70 is configured to selectively cause a given of the batteries 62, 63 to power the light source 16 based on a charge of the given one of the batteries 62, 63. For example, in this embodiment, the controller 70 is configured to assess a charge of each of the batteries 62, 63 and, based on the charge of each of the batteries 62, 63, selectively cause either one of the batteries 62, 63 to power the light source 16 and cause the other one of the batteries 62, 63 to be charged by the solar panel 66. As such, each of the batteries 62, 63 may be referred to as having two operation modes, notably a "powering mode" whereby the battery powers the light source 16 and a "charging mode" whereby the battery is charged by the solar panel 66. The controller 70 may change which one of the batteries 62, 63 is in its powering mode and which one of the batteries 62, 63 is in its charging mode based on a characteristic of the batteries 62, 63 (e.g., the charge of the batteries 62, 63). For instance, in one example of implementation, the controller 70 may switch the respective operation modes of the batteries 62, 63 upon detecting that the charge of the battery that is in the powering mode has reached a given low threshold level. That is, when the charge of the battery that is in the powering mode reaches the low threshold level, the controller 70 may change the operation modes of the batteries 62, 63 such that the battery that was previously in the powering mode (i.e., the battery that reached the low threshold level of charge) is switched into its charging mode and the battery that was previously in its charging mode is switched into its powering mode.

In this embodiment, the controller 70 is implemented by a printed circuit board (PCB) 72 of the external device 14. Since it is used for control purposes, in this example, the PCB 72 may be referred to as a "control" board or card.

Figure 12B:
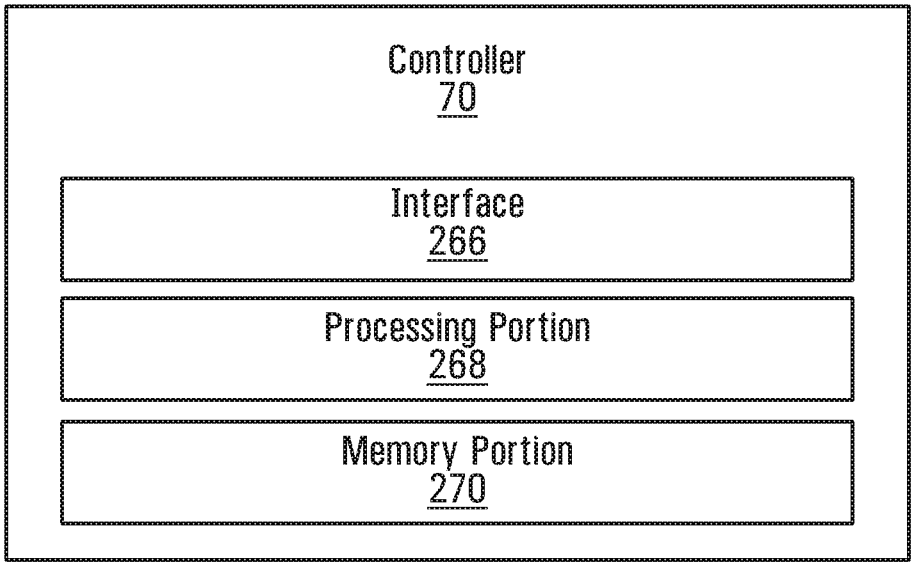
FIG. 12B is a block diagram representation of an example of an embodiment of a controller of the external device.

As shown in FIG. 12B, in some embodiments, the controller 70 of the external device 14 may comprise an interface 266, a processing portion 268, and a memory portion 270, which are implemented by suitable hardware and/or software. The interface 266 comprises one or more inputs and outputs allowing the controller 70 to receive input signals from and send output signals to other components to which the controller 70 is connected (i.e., directly or indirectly connected). The processing portion 268 comprises one or more processors for performing processing operations that implement functionality of the controller 70. A processor of the processing portion 268 may be a general-purpose processor executing program code stored in the memory portion 270. Alternatively, a processor of the processing portion 268 may be a specific-purpose processor comprising one or more preprogrammed hardware or firmware elements (e.g., application-specific integrated circuits (ASICs), electrically erasable programmable read-only memories (EEPROMs), etc.) or other related elements. The memory portion 270 comprises one or more memories for storing program code executed by the processing portion 268 and/or data used during operation of the processing portion 268. A memory of the memory portion 270 may be a semiconductor medium (including, e.g., a solid-state memory), a magnetic storage medium, an optical storage medium, and/or any other suitable type of memory. A memory of the memory portion 270 may be read-only memory (ROM) and/or random-access memory (RAM), for example.

The housing 13 houses at least part of the power supply 60 and at least part of the controller 70. In this embodiment, the solar panel 66 and the housing 13 are mounted together to enclose a remainder of the power supply 60 (notably the batteries) and the controller 70 (including the PCB 72 implementing it).

As shown in FIG. 13, in this embodiment, the light-emitting traffic sign 12 comprises a connector 90 for connecting the light-emitting traffic sign 12 to the external device 14. More particularly, in this embodiment, the connector 90 connects the controller 70 and the power supply 60 of the external device 14 to the light source 16. In this example, the connector 90 is mounted to the panel 20. For instance, the panel 20 comprises an opening 56 that extends from the front surface $\mathbf{21}_1$ to the back surface $\mathbf{21}_2$ of the panel 20 and which is of a suitable size and shape for receiving the connector 90. The connector 90 is linked to the PCB 36 of the light source 16. A protective film (not shown) may be apposed onto a front surface 39 of the PCB 36 (which in this case corresponds to the front surface 48 of the base 34 of the light source 16) to maintain the PCB 36 in place. The connector 90 is sealingly disposed in the opening 56 using, for example, epoxy, silicone, urethane or any suitable thermoplastic. In this example, the connector 90 is disposed in the opening 56 and a seal (not shown) covers the connector 90 and substantially fills the opening 56. Electrical circuitry conveys electrical signals from the power supply 60 and the controller 70 of the external device 14 to the light source 16 through the cable 80. In some instances, the connector 90 may comprise a controller to regulate which ones of the light emitters $\mathbf{32}_1$-$\mathbf{32}_x$, if any, are to be lit.

In some embodiments, as shown in FIG. 11, the external device 14 may comprise a wireless interface 15 for wirelessly communicating with a remote communication apparatus 58. For example, the wireless interface 15 may be able to receive and/or transmit different signals wirelessly from and/or to the remote communication apparatus 58 to control the operation of the light-emitting traffic sign 12. The wireless interface 15 may wirelessly communicate over a wireless communication link, which may be implemented by a wireless network (e.g., a cellular network) or a satellite link, for instance.

In some embodiments, the external device 14 further comprises a sensor 17 which detects certain changes in the environment of the light-emitting sign 12. For instance, the changes in the environment that can be detected by the sensor 17 may be related to temperature, electrical power, signal transmission, moisture and water level, or the like. For example, the sensor 17 may detect a change in temperature (e.g., a temperature drop), moisture (e.g., precipitation) or water level (e.g., flooding) in the environment. The sensor 17 is in communication with the controller 70 and conveys a signal to the controller 70 conveying the change that is detected in the environment. In response to the signal from the sensor 17, the controller 70 may cause one or more of the light emitters $\mathbf{32}_1$-$\mathbf{32}_x$ to go on and/or off in order to convey an information relating to the change that is detected in the environment. The sensor 17 may be mounted on the external device 14, such as on the housing 13 to be exposed to the surrounding environment of the external device 14.

Each of the light-emitting traffic sign 12 and the external device 14 may comprise an attachment (not shown) to attach the light-emitting traffic sign 10 and the external device 14 to a holding structure such as a post, a pole, a frame or the like.

The light-emitting traffic sign apparatus 10 may be implemented in various other ways in other embodiments.

Figure 14:
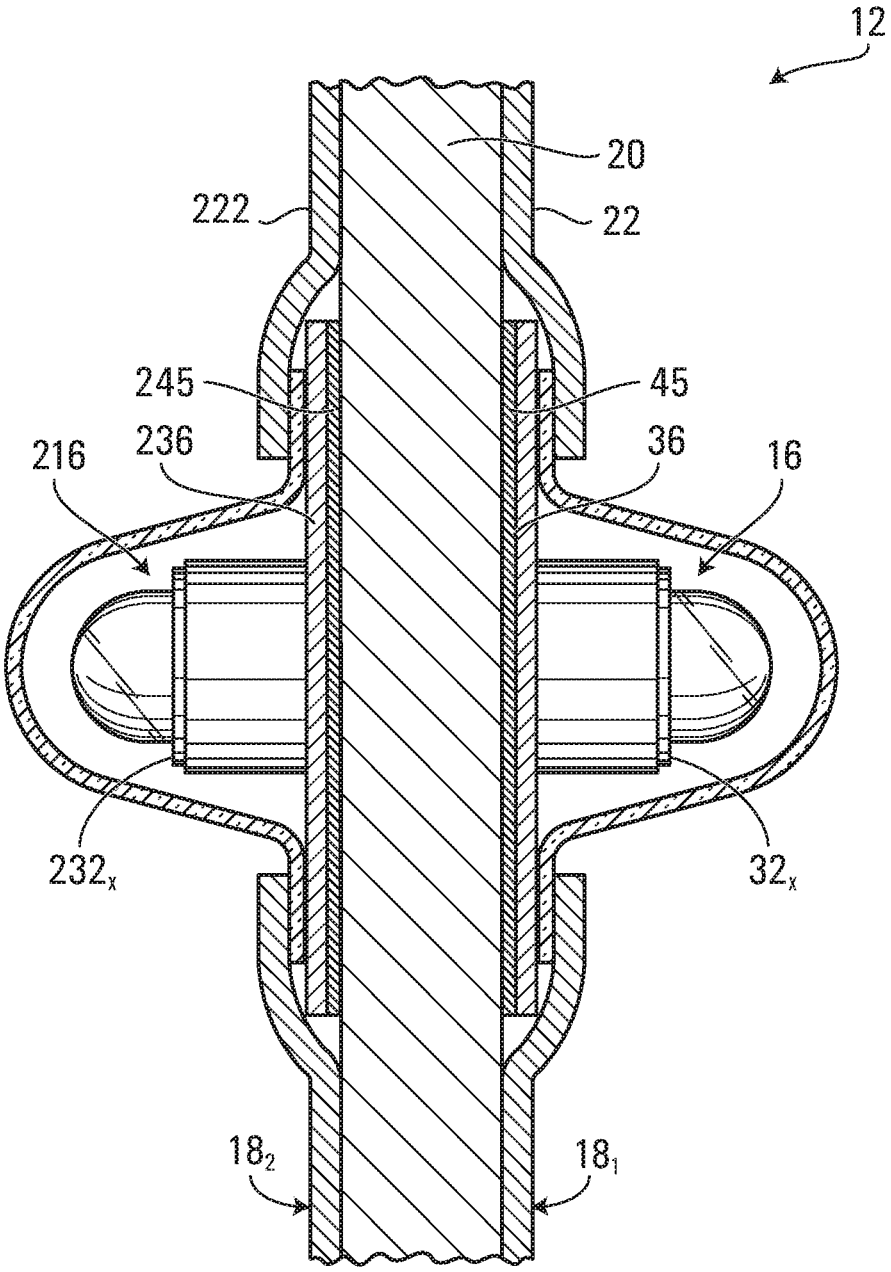
FIG. 14 shows an example of an embodiment of the light-emitting sign in which the light-emitting sign conveys information from its front surface and its back surface.

For example, in some embodiments, as shown in FIG. 14, the light-emitting sign 12 may convey information from its front surface $\mathbf{18}_1$ and its back surface $\mathbf{18}_2$. In this embodiment, the light-emitting sign 12 comprises the outer layer 22 and the light source 16 (which, in this, case can be considered a first outer layer 22 and a first light source 16 respectively) adjacent the front surface $\mathbf{21}_1$ of the panel 20, and a second outer layer 222 and a second light source 216 adjacent the back surface $\mathbf{21}_2$ of the panel 20. The second outer layer 222 and the second light sources 216 are substantially similar to that described above in respect of the first outer layer 22 and the first light source 16. In this example, a position of the first light source 16 on the front surface $\mathbf{21}_1$ of the panel 20 corresponds to a position of the second light source 216 on the back surface $\mathbf{21}_2$ of the panel 20 such that the light-emitting sign 12 can convey the same information on its front and back surfaces $\mathbf{18}_1$, $\mathbf{18}_2$.

Figure 15:
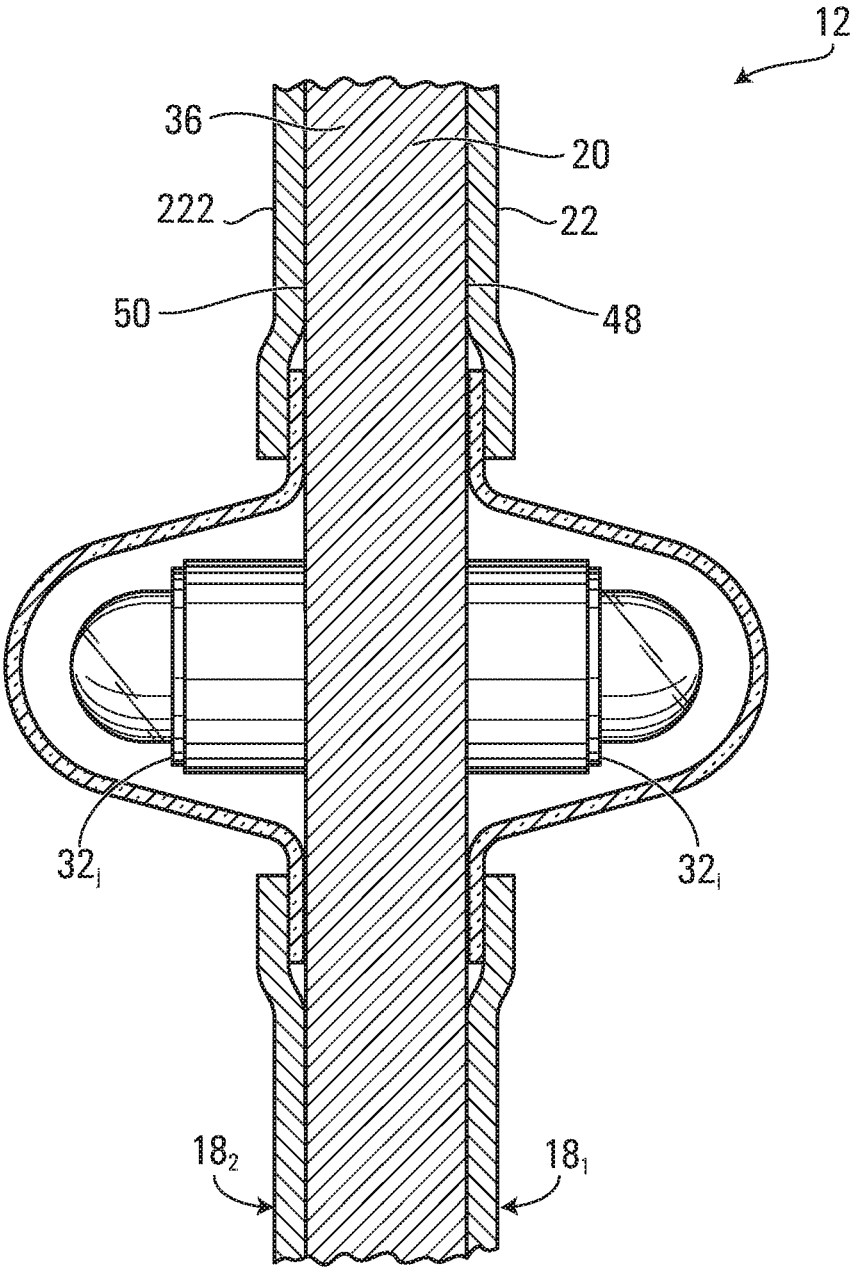
FIG. 15 shows a variant of the light-emitting sign of FIG. 14 in which at least part of the light source is embedded in the panel.

In some embodiments, as shown in FIG. 15, the panel 20 of the light-emitting sign 12 may comprise one or more insulating materials in order to receive the light source 16 without an insulating layer present between the panel 20 and the light source 16. The insulating material of the panel 20 may comprise wood (e.g., plywood), polymeric material (e.g., plastic such as acrylic, polycarbonate, high density polyethylene (HDPE)), or any other suitable insulating material. In such embodiments, at least part of the light source 16 may be embedded in the panel 20. For example, the base 34 of the light source 16 comprising the PCB 36 may be embedded into the panel 20. Moreover, the substrate 52 of the PCB 36 has circuits printed on both its front and back surfaces 48, 50 to accommodate the light emitters $\mathbf{32}_1$-$\mathbf{32}_x$ on both surfaces. In such embodiments, the outer layers 22, 222 are disposed on each of the front and back surfaces $\mathbf{21}_1$, $\mathbf{21}_2$ of the panel 20.

Figure 16:
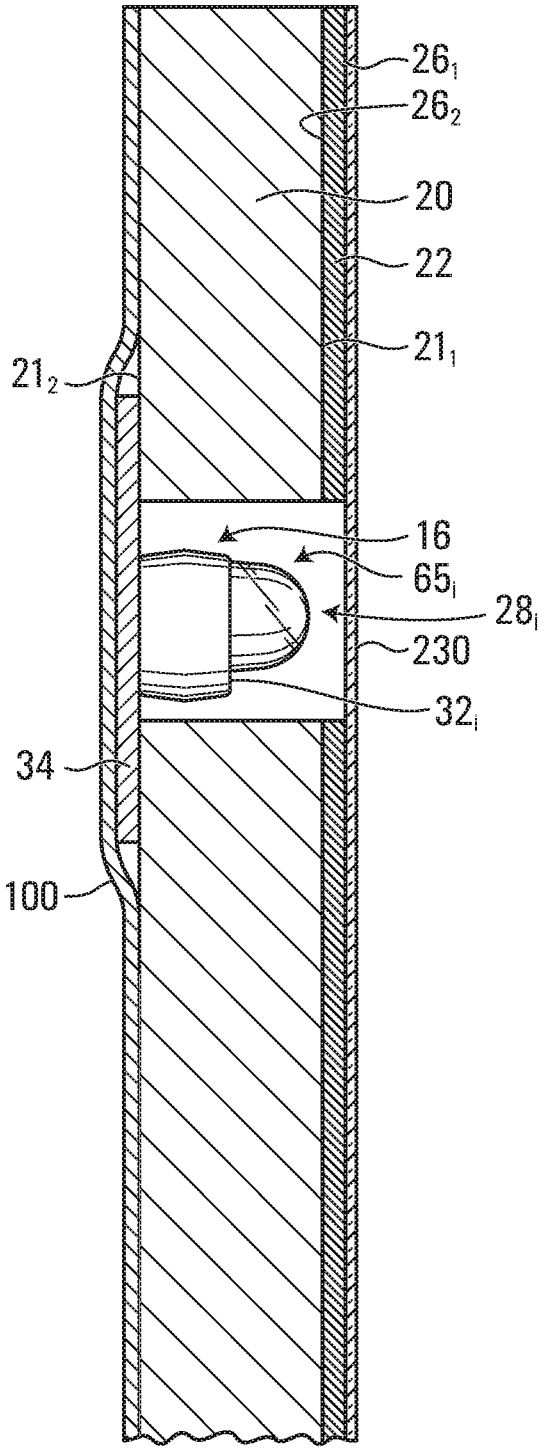
FIG. 16 shows an example of an embodiment of the light-emitting sign in which a light emitter of the light source is received in the panel.

In other embodiments, as shown in FIG. 16, the panel 20 may receive therein at least part of the light source 16. That is, one or more components of the light source 16 may be located between the front and back surfaces $\mathbf{21}_1$, $\mathbf{21}_2$ of the panel 20.

To that end, in this embodiment, the panel 20 comprises a plurality of openings $\mathbf{65}_1$-$\mathbf{65}_x$ spanning the entirety of the thickness $T_P$ of the panel 20 (i.e., from the front surface $\mathbf{21}_1$ to the back surface $\mathbf{21}_2$) for receiving at least part of the light source 16. More specifically, each opening $\mathbf{65}_i$ is sized and shaped to receive a respective light emitter $\mathbf{32}_i$ such that one or more of the light emitters $\mathbf{32}_1$-$\mathbf{32}_x$ are located between the front and back surfaces $\mathbf{21}_1$, $\mathbf{21}_2$ of the panel 20. In other embodiments, the opening 65 may be sized and shaped to receive more than one light emitter $\mathbf{32}_i$ (e.g., two light emitters). Moreover, each opening $\mathbf{65}_i$ of the panel 20 is aligned with a respective opening $\mathbf{28}_i$ of the outer layer 22 such that light emitted from the light emitter $\mathbf{32}_i$ is diffused outwardly from the light-emitting sign 12. A light-passing cover 230 is disposed onto the front surface $\mathbf{26}_1$ of the outer layer 22 to prevent atmospheric agents from reaching the interior of the opening $\mathbf{20}_4$. The light-passing cover 230 is similar to the light-passing cover 30 described above, notably comprising a transparent polymeric material (e.g., a transparent thermoplastic) to allow the light emitted by the light emitter $\mathbf{32}_i$ to pass through the light-passing cover 230 and to diffuse outwardly from the light-emitting sign 12. In this embodiment, the light-passing cover 230 is an outermost layer of the light-emitting sign 12 such that it defines at least part of the front surface $\mathbf{18}_1$ of the light-emitting sign 12. Moreover, the light-passing cover 230 is flat since it does not have to accommodate the thickness $T_{LS}$ of the light source 16. Furthermore, in this embodiment, the base 34 of the light source 16 is supported on the back surface $\mathbf{21}_2$ of the panel 20 and a protective layer 100 is disposed on the back surface $\mathbf{21}_2$ of the panel 20 to maintain the base 34 of the light source 16 in place and to prevent atmospheric agents from reaching the PCB 36 and the interior of the opening $\mathbf{65}_i$. In such embodiments, the panel 20 comprises one or more insulating materials as described above with respect to the embodiment of FIG. 15.

Figure 17:
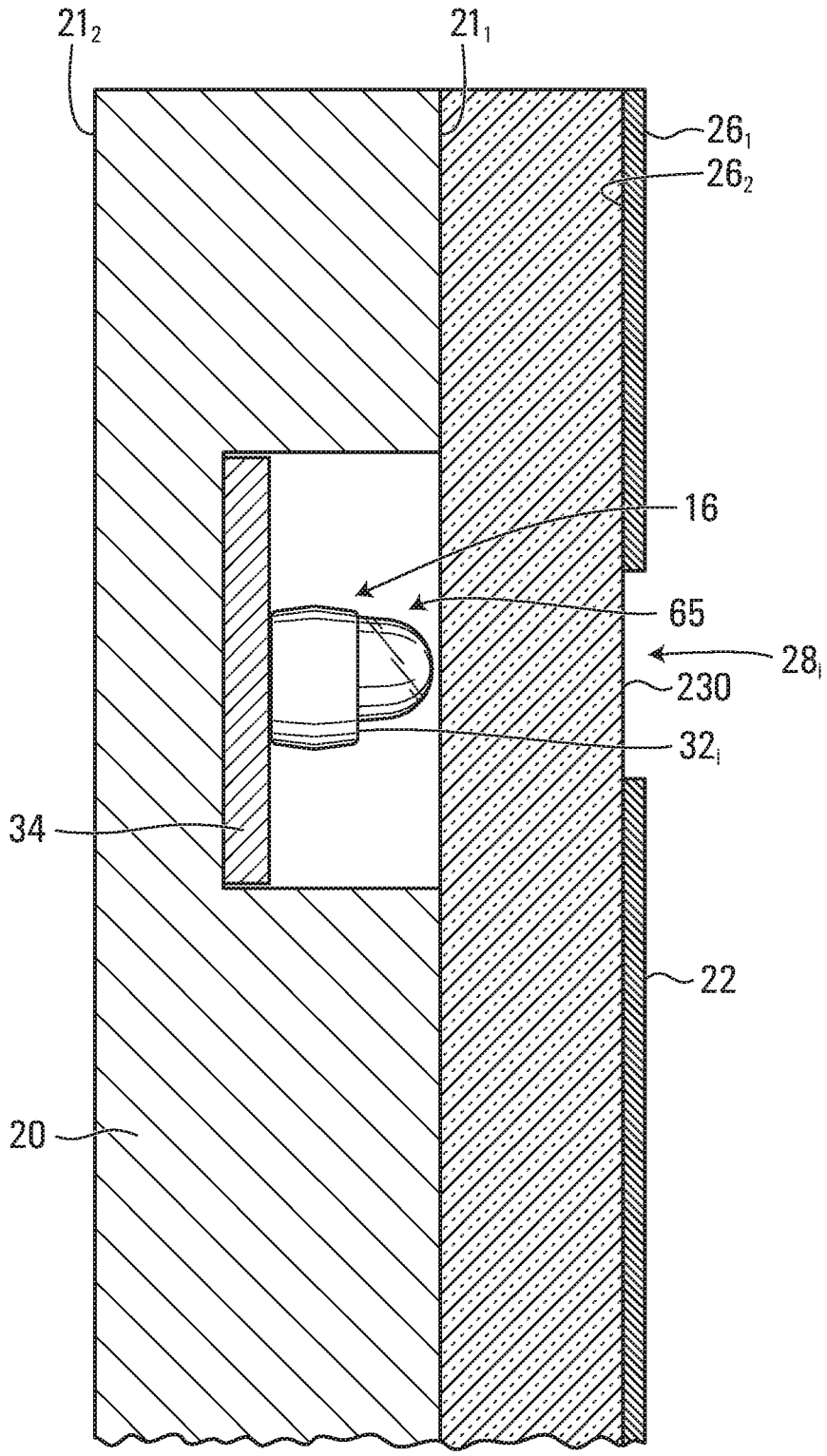
FIG. 17 shows a variant of the light-emitting sign of FIG. 16 in which an opening of the panel in which the light emitter is received does not extend along an entirety of a thickness of the panel.

In a variant, as shown in FIG. 17, each opening $\mathbf{65}_i$ may extend along a part of the thickness $T_P$ of the panel 20 rather than its entirety. For example, the opening $\mathbf{65}_i$ may be disposed on the front surface $\mathbf{21}_1$ of the panel 20 and extend along more than half the thickness $T_P$ of the panel 20 (i.e., a majority of the thickness $T_P$ of the panel 20). In this example, the opening $\mathbf{65}_i$ receives at least part of the light source 16 therein. For instance, the opening 65*i* may receive a portion of the base 34 of the light source 16 and a light emitter $\mathbf{32}_i$. Furthermore, in this example of implementation, the light-passing cover 230 is disposed between the panel 20 and the outer layer 22 and covers the opening $\mathbf{65}_i$ preventing atmospheric agents from reaching the interior of the opening $\mathbf{65}_i$. In this variant, the light-passing cover 230 spans a majority of the front surface $\mathbf{21}_1$ of the panel 20. The light-passing cover 230 may be affixed between the panel 20 and the outer layer 22 in any suitable way. For instance, in this example, the light-passing cover 230 is adhesively mounted onto the back surface $\mathbf{26}_2$ of the outer layer 22.

Figure 18:
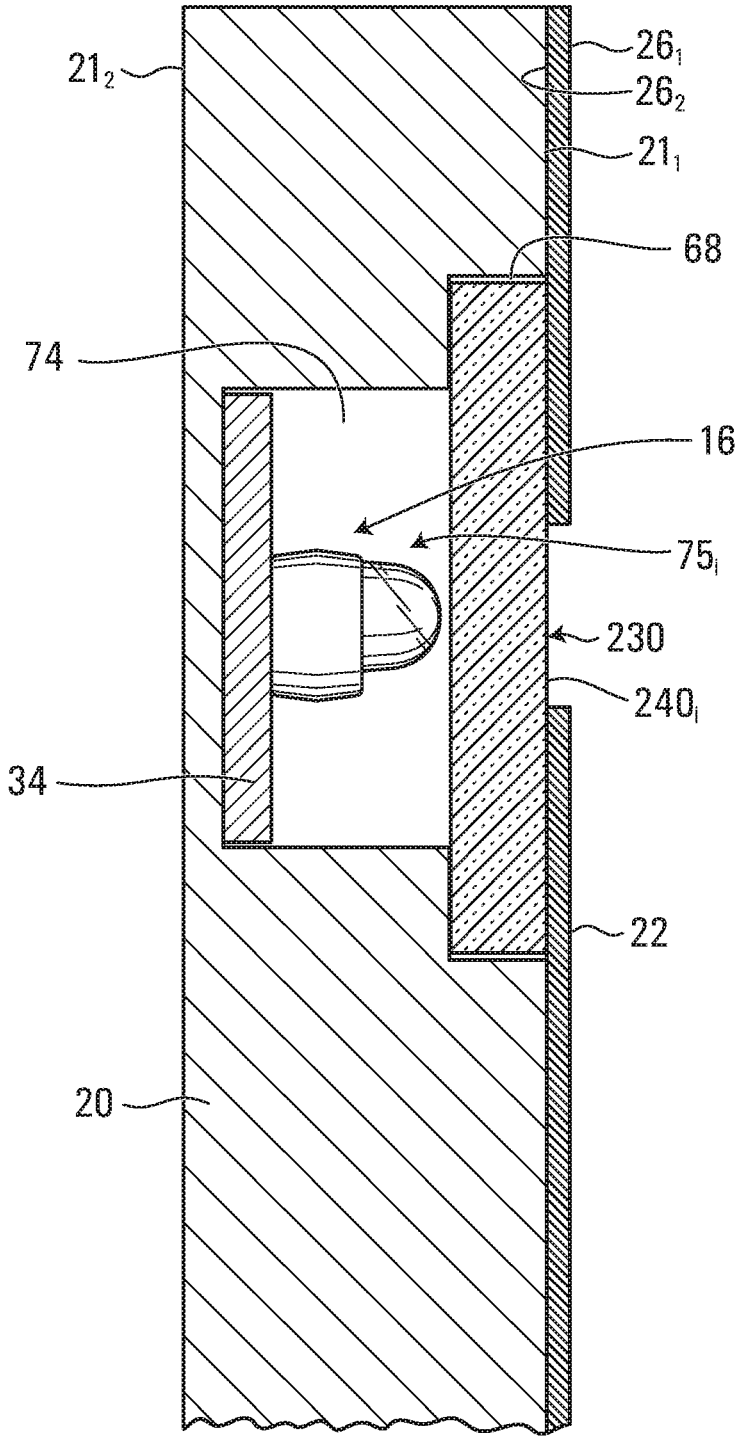
FIG. 18 shows a variant of the light-emitting sign of FIG. 17 in which a light-passing covering element is received in the opening of the panel in which the light emitter is received.

In accordance with another variant, as shown in FIG. 18, the light-passing cover 230 may comprise a plurality of light-passing covering elements $\mathbf{240}_1$-$\mathbf{240}_c$ for covering a plurality of openings $\mathbf{75}_1$-$\mathbf{75}_x$ of the panel 20. Each opening $\mathbf{75}_i$ extends along a majority of the thickness $T_P$ of the panel 20 and comprises a first portion 68 and a second portion 74. The first portion 68 is larger than the second portion 74 along a plane parallel to the front surface $\mathbf{21}_1$ of the panel 20 and is configured to receive a light-passing covering element $\mathbf{240}_i$. The light-passing covering element $\mathbf{240}_i$ has a size and shape suitable for fitting in the first portion 68 while covering the second portion 74 of the opening $\mathbf{75}_i$. The second portion 74 of the opening $\mathbf{75}_i$ is configured to receive at least part of the light source 16. For instance, in this example of implementation the second portion 74 of the opening $\mathbf{75}_i$ receives a portion of the base 34 of the light source 16 and a light emitter $\mathbf{32}_i$.

Figure 19:
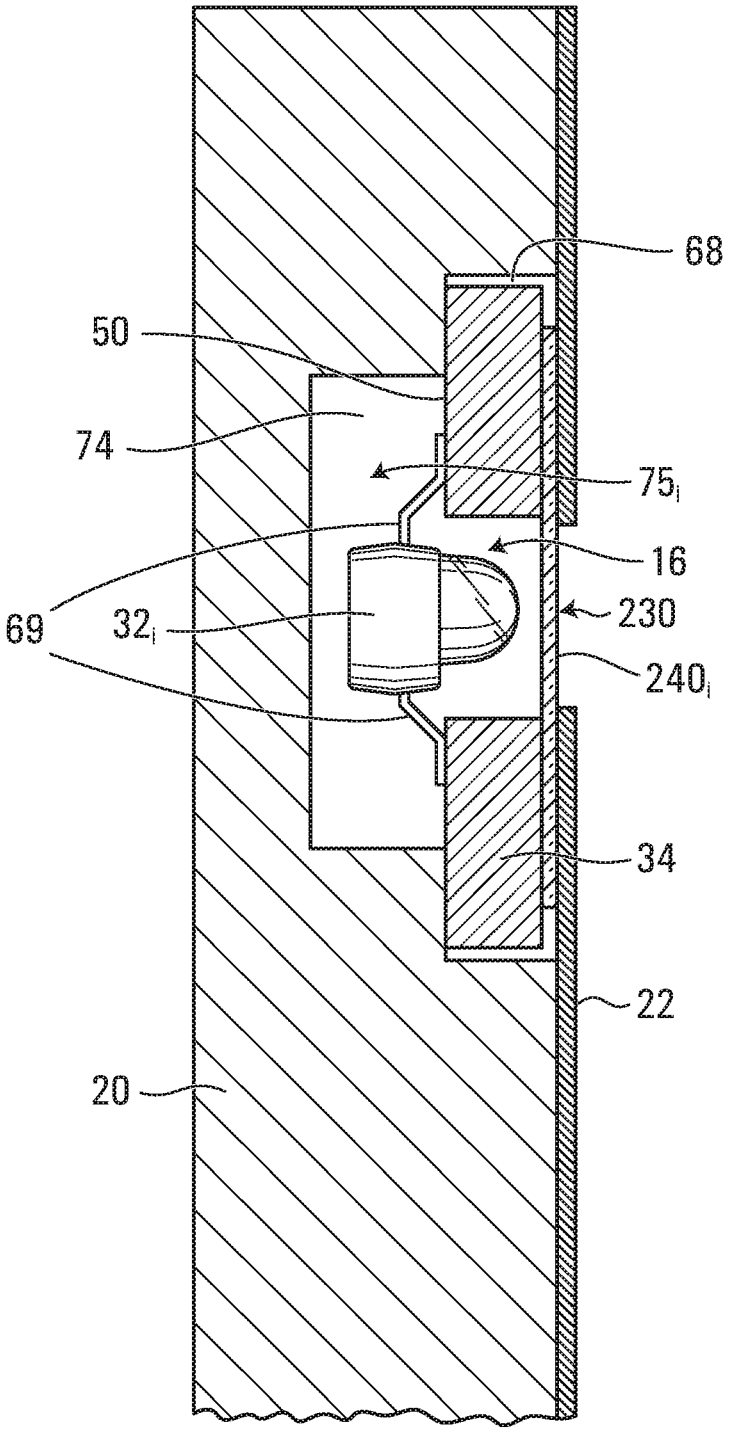
FIG. 19 shows a variant of the light-emitting sign of FIG. 18 in which the light emitter is affixed to a base of the light source differently.
Figure 20A:
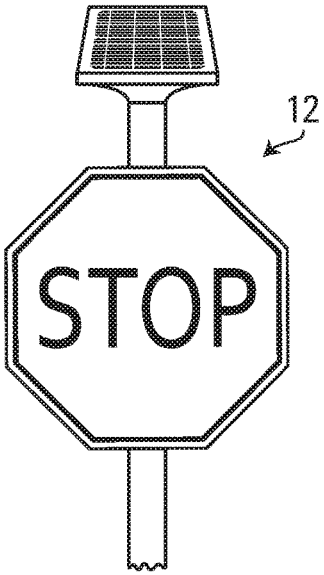
FIGS. 20A to 20H are schematic representations of examples of light-emitting sign apparatuses comprising a light-emitting sign in accordance with further embodiments.
Figure 20B:
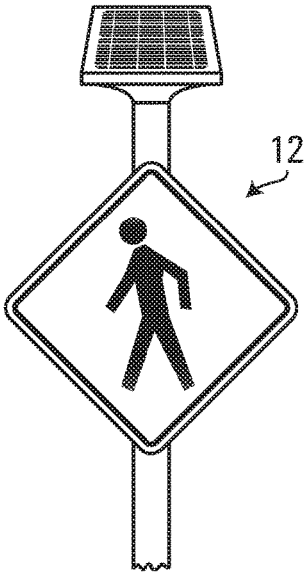
Figure 20C:
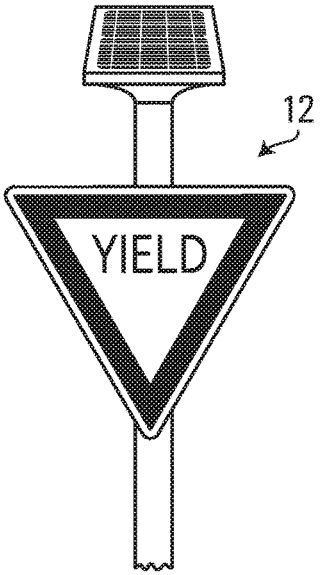
Figure 20D:
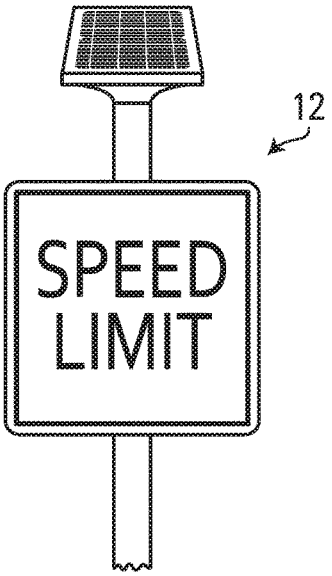
Figure 20E:
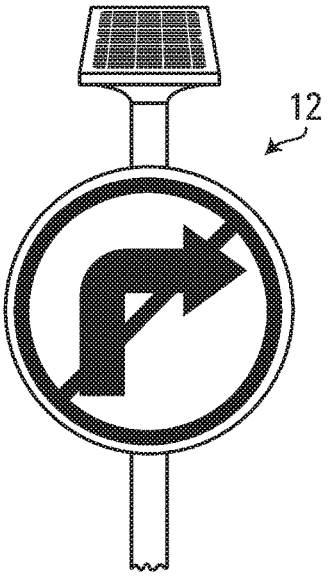
Figure 20F:
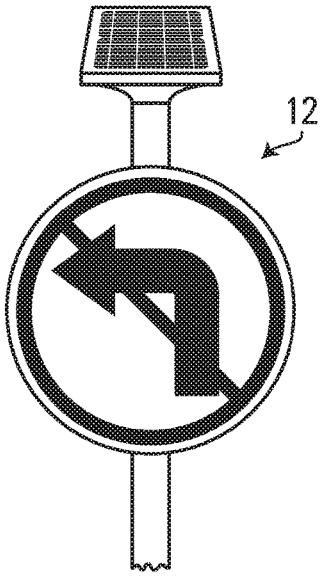
Figure 20G:
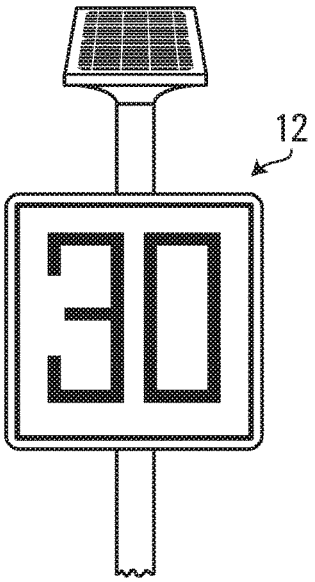
Figure 20H:
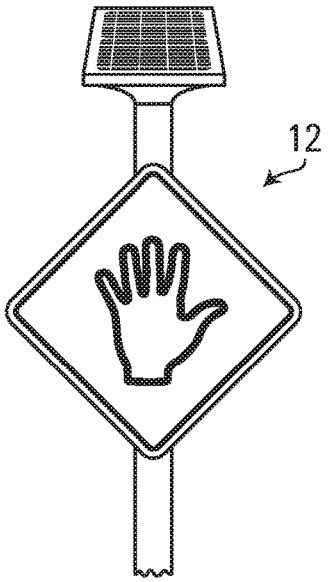

In accordance with another variant, as shown in FIG. 19, the base 34 of the light source 16 may be disposed in the enlarged portion 68 of the opening $\mathbf{75}_i$. In this example of implementation, the light emitter $\mathbf{32}_i$ is affixed to the back surface 50 of the base 34 via a conductive connector 69 that conductively connects the light emitter $\mathbf{32}_i$ to the base 34. In this example, the conductive connector 69 comprises a plurality of legs extending from the light emitter $\mathbf{32}_i$. The conductive connector 69 may be affixed to the base 34 in any suitable way (e.g., soldering). Furthermore, in this variant, the light-passing covering element $\mathbf{240}_i$ that covers the opening $\mathbf{75}_i$ is also received in the first portion 68 of the opening $\mathbf{75}_i$.

Although in this embodiment and in the various implementations thereof, the light-emitting traffic sign 12 is a parking sign, the light-emitting sign 12 may be any other traffic sign in other embodiments.

Figure 21A:
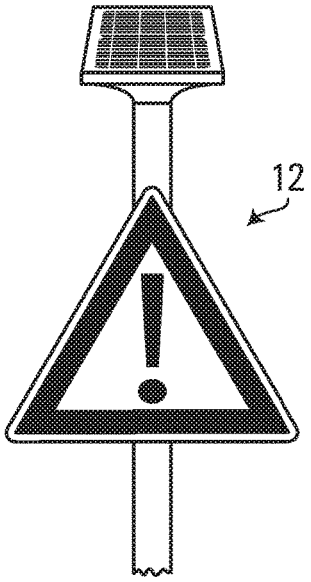
FIGS. 21A to 21C are schematic representations of examples of light-emitting sign apparatuses comprising a light-emitting sign in accordance with further embodiments.
Figure 21B:
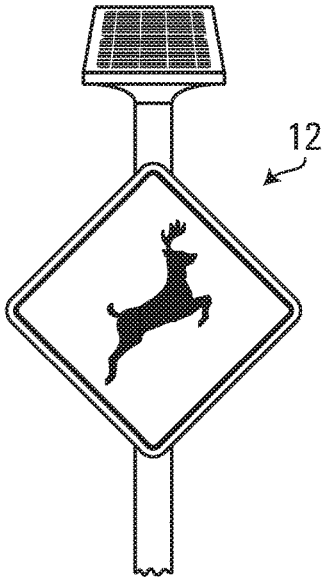
Figure 21C:
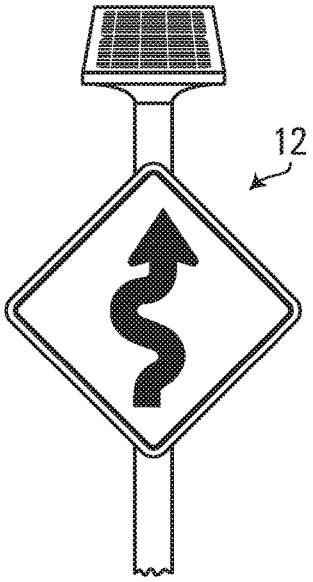

For example, in other embodiments, the light-emitting traffic sign 12 may be a regulatory sign (e.g., a stop sign, a yield sign, a speed limit sign, a pedestrian crossing sign, a no-left-turn or no-right-turn sign, etc.) as shown in FIGS. 20A-F, or a warning sign (e.g., a deer-crossing sign, a winding road sign, etc.) as shown in FIGS. 21A-21C.

Figure 22:
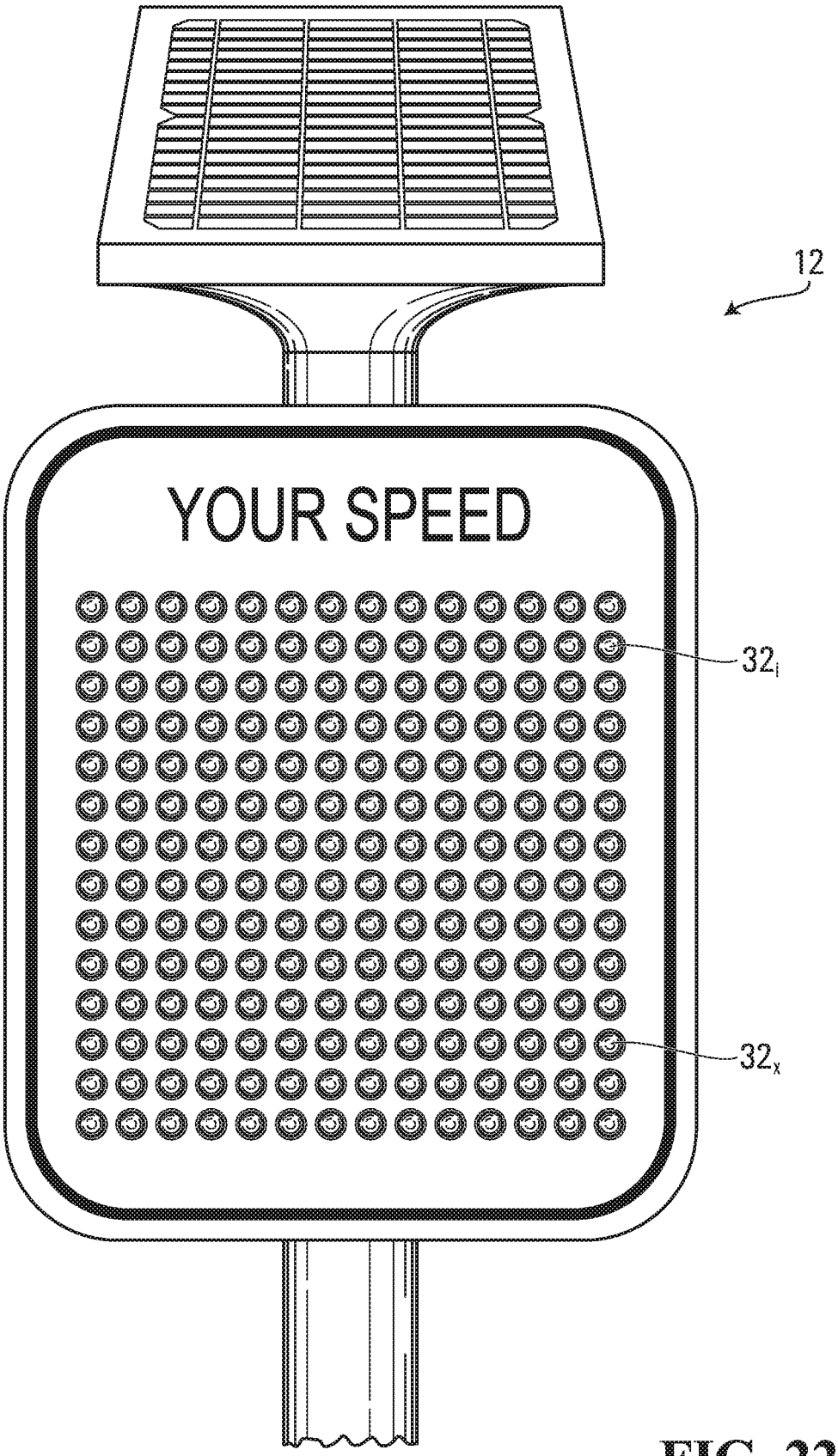
FIG. 22 shows a light-emitting sign in accordance with another embodiment in which the light-emitting sign displays the speed of an incoming vehicle.
Figure 23:
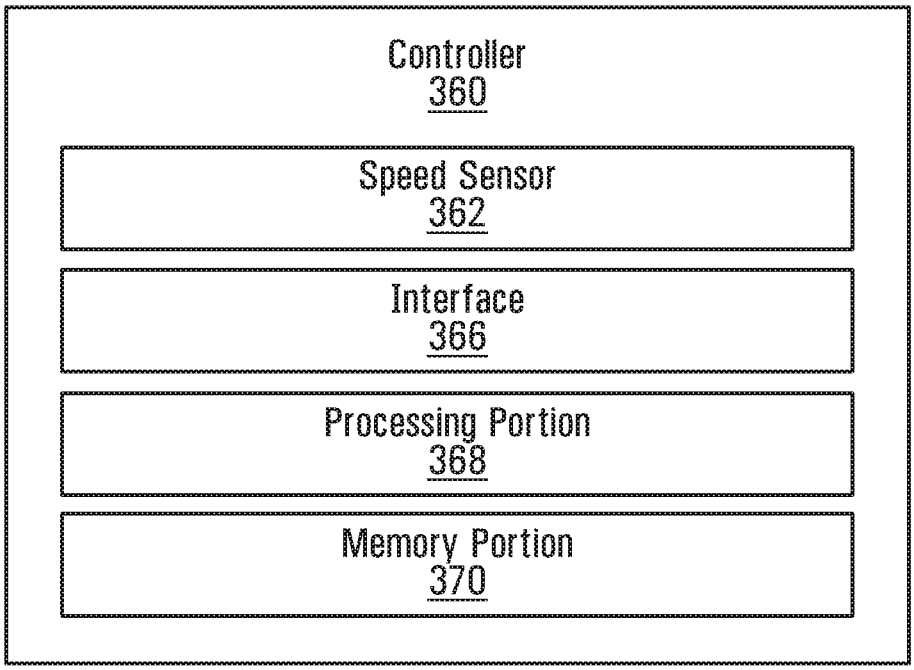
FIG. 23 shows a block diagram representation of an exemplary controller of the light-emitting sign of FIG. 22.

Furthermore, in some embodiments, with reference to FIGS. 22 and 23, the light-emitting traffic sign 12 may be a speed display sign that displays a speed of an incoming vehicle. In such embodiments, the PCB 36 comprises a controller 360 having a similar functionality as the controller 160 described above, notably comprising an interface 366, a processing portion 368, and a memory portion 370 that are similar to the interface 166, the processing portion 168 and the memory portion 170. The controller 360 further comprises a speed sensor 362 for sensing the speed of an incoming vehicle. For example, the speed sensor 362 may comprise a radar that uses the Doppler effect to measure the incoming vehicle's speed. The speed sensor 362 may be configured in any other suitable way. As shown in FIG. 22, in this embodiment, the light emitters $\mathbf{32}_1$-$\mathbf{32}_x$ of the light source 16 are positioned such as to form an array. The controller 360 is configured to control which ones of the light-emitters $\mathbf{32}_1$-$\mathbf{32}_x$ of the array are lit in order to convey the speed of the incoming vehicle as sensed by the speed sensor 362. That is, the controller 360 selects a subset of the light-emitters $32_1$-$32_x$ of the array to be lit such as to visually represent in the array a number associated with the speed of the incoming vehicle (e.g., 50 km/h).

As yet another example, in some embodiments, as shown in FIG. 7, the light-emitting traffic sign 12 may be a variable-messaging sign that can vary a message it displays (e.g., to provide information about accidents, congestion, roadwork, or speed limits on certain segments of roads).

Figure 24:
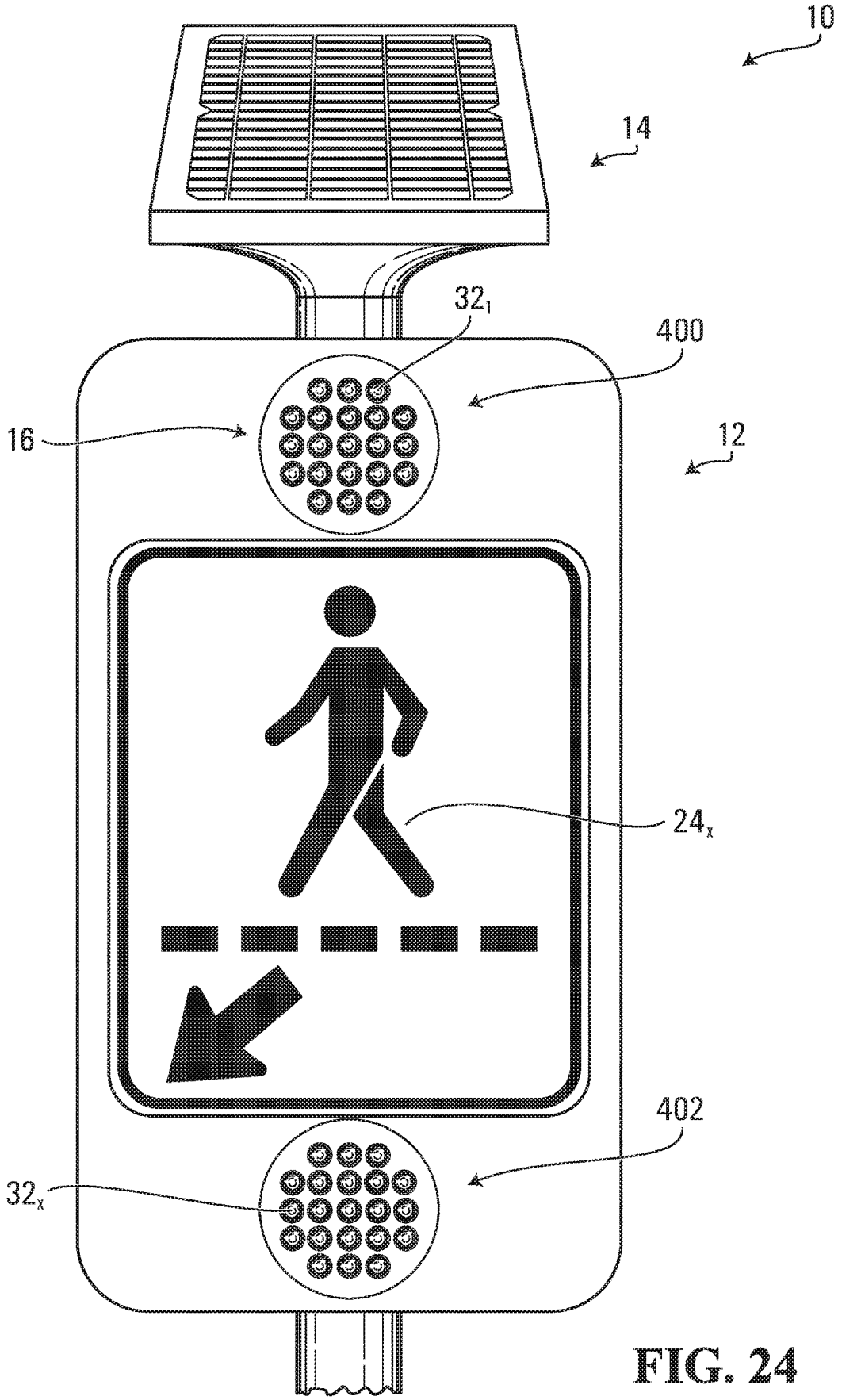
FIG. 24 shows an example of an embodiment in which the light-emitting sign is a flashing traffic sign.

In some embodiments, as shown in FIG. 24, the light-emitting traffic sign 12 may be a flashing traffic sign. More specifically, the light source 16 of the light-emitting traffic sign 12 may "blink" by being alternatingly lit and extinguished. For instance, in one example of implementation, a first subset 400 of the light-emitters $32_1$-$32_x$ may be lit while a second subset 402 of the light-emitters $32_1$-$32_x$ is extinguished and, subsequently, the first subset 400 of the light-emitters $32_1$-$32_x$ may be extinguished while the second subset 402 of the light-emitters $32_1$-$32_x$ is lit. The first and second subsets 400, 402 of the light-emitters $32_1$-$32_x$ may be arranged to have any shape (e.g., round, square) or form any suitable character (e.g., a symbol). A character $24_x$, such as a "pedestrian crossing" character, may be provided on the outer layer 22 of the light-emitting traffic sign 12 adjacent to the first and second subsets 400, 402 of the light-emitters $32_1$-$32_x$. In some examples, all the light-emitters $32_1$-$32_x$ of the light source 16 may be lit and extinguished simultaneously such that all the light-emitters $32_1$-$32_x$ blink simultaneously. Moreover, in some examples, the light source 16 may comprise more than two subsets of the light-emitters $32_1$-$32_x$ or, in other examples, a single subset of the light-emitters $32_1$-$32_x$.

Figure 28:
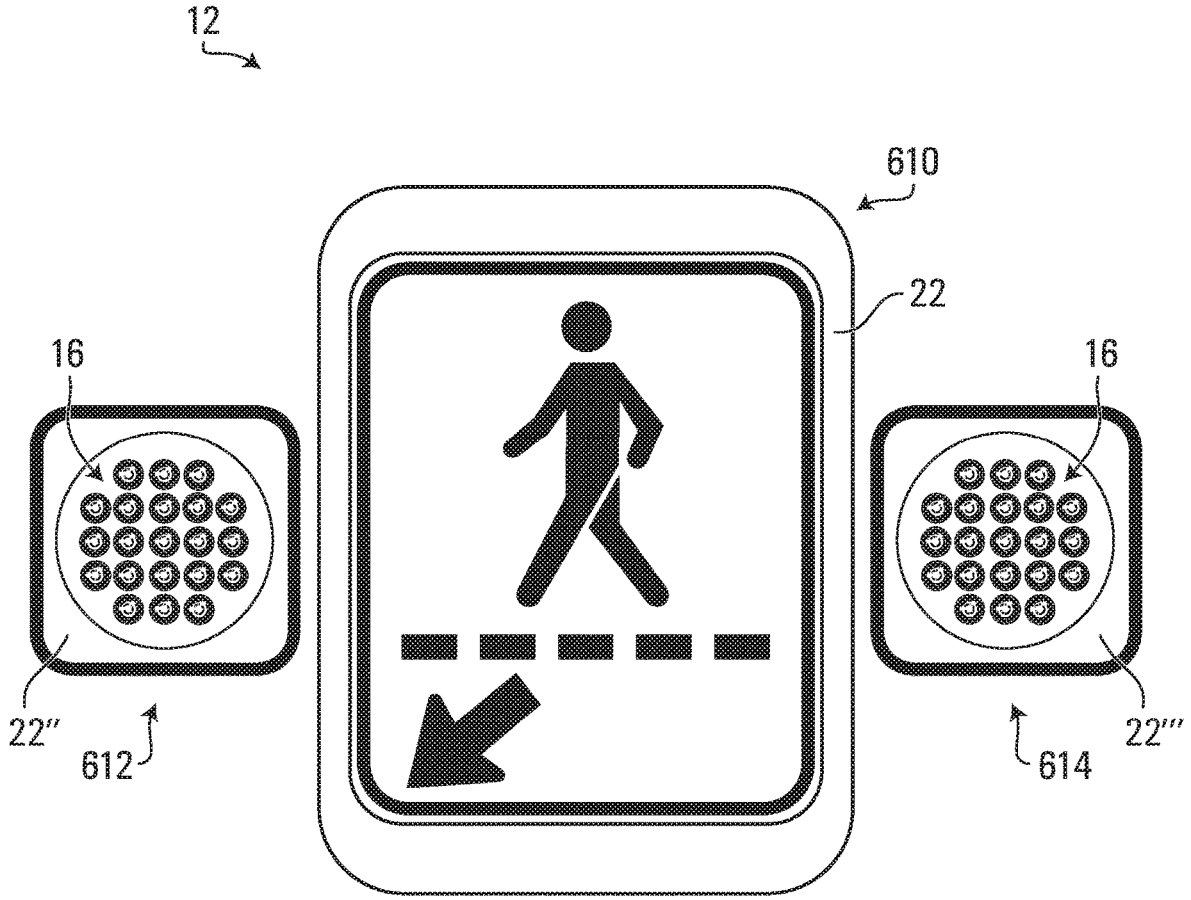
FIGS. 28 and 29 show examples of an embodiment in which the light-emitting sign comprises various portions mounted adjacent one another.
Figure 29:
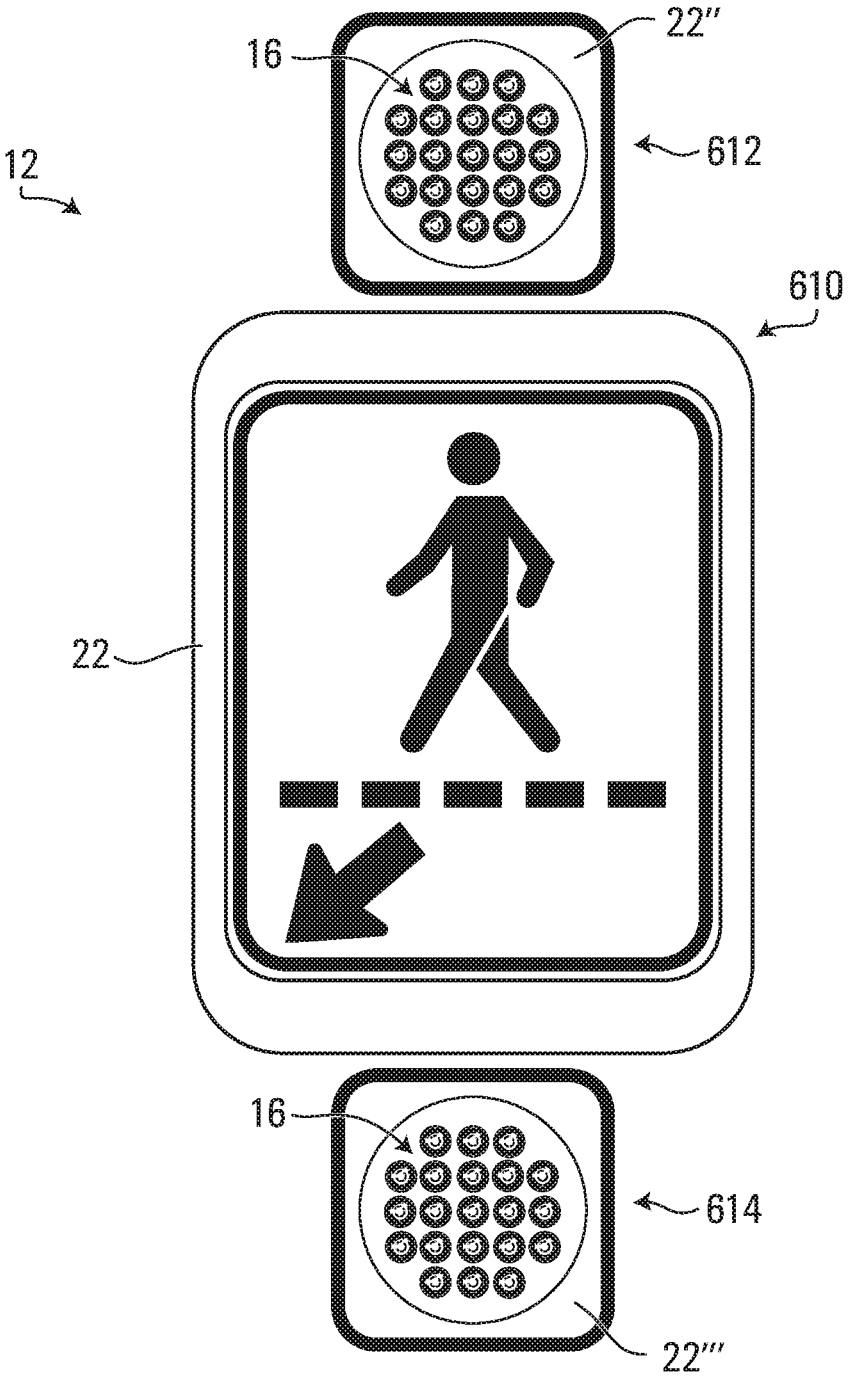

Furthermore, while the light-emitting traffic sign 12 has been so far described as comprising a single panel 20 and outer layer 22, in other embodiments, as shown in FIGS. 28 and 29, the light-emitting traffic sign 12 may comprise separate portions, each comprising its respective panel and outer layer (such as the panel 20 and outer layer 22 described above). For instance, in one example of implementation, the light-emitting traffic sign 12 may comprise a first portion 610, a second portion 612 and a third portion 614 each comprising its respective panel and outer layer 22, 22", 22". The light source 16 of the light-emitting traffic sign 12 can be distributed amongst the first, second and third portions 610, 612, 614 of the light-emitting traffic sign 12. For example, the first portion 610 of the light-emitting traffic sign 12 may not comprise any portion of the light source 16 (i.e., is free of the light-emitters $32_1$-$32_x$) but may comprise a character such as as "pedestrian crossing" character disposed on the outer layer 22. As shown in FIG. 28, the light source 16 may instead be disposed on the second and third portions 612, 614 of the light-emitting traffic sign 12. The second and third portions 612, 614 are mounted adjacent the first portion 610 and, more specifically, in this example they are mounted adjacent each lateral side of the first portion 610 of the light-emitting traffic sign 12. In other examples, as shown in FIG. 29, the second and third portions 612, 614 may be mounted adjacent a top and bottom of the first portion 610 of the light-emitting traffic sign 12.

Figure 27:
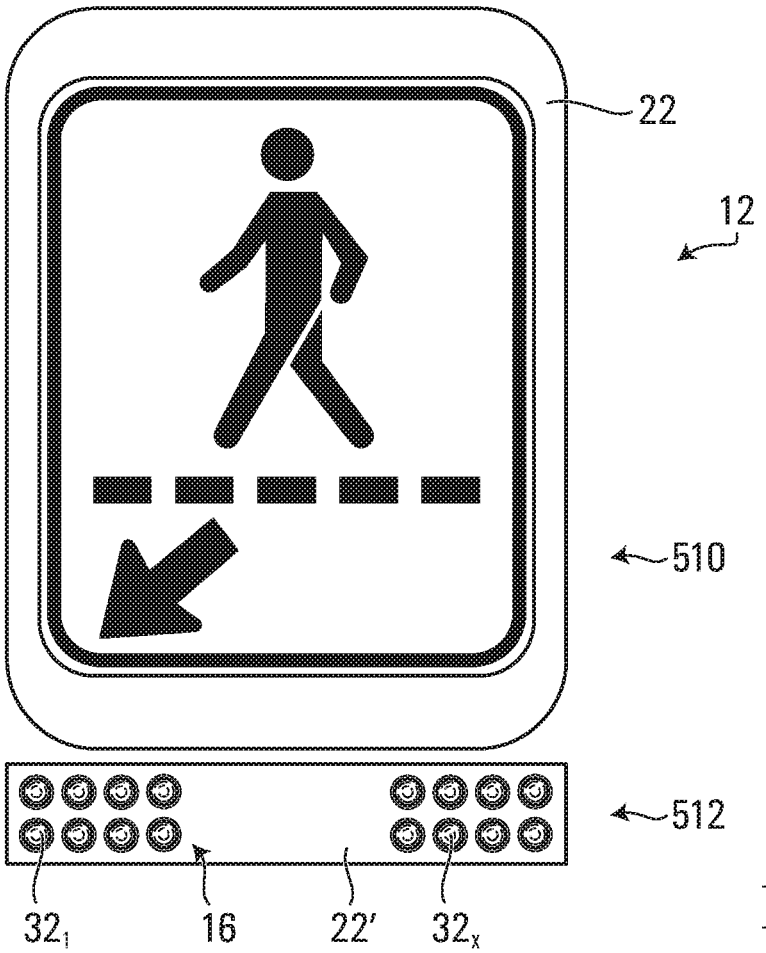
FIG. 27 shows an example of an embodiment in which the light-emitting sign is a stroboscopic traffic sign.

In some embodiments, as shown in FIG. 27, the light-emitting traffic sign 12 may be a stroboscopic traffic sign. For instance, the light-emitting traffic sign 12 may comprise a first portion 510 and a second portion 512 mounted adjacent to the first portion 510, each one of the first and second portions 510, 512 comprising a respective panel and outer layer 22, 22'. In this example of implementation, the light source 16 of the light-emitting traffic sign 12 is comprised by the second portion 512 such that the light-emitters $32_1$-$32_x$ are disposed thereon while the first portion 510 is free of light-emitters. The first portion 510 may comprise a character such as a "pedestrian crossing" character disposed on the outer layer 22. The activation of the light-emitters $32_1$-$32_x$ of the light source 16 can be controlled to display different patterns. For instance, in a "strobe" mode, the light-emitters $32_1$-$32_x$ of the light source 16 may simultaneously emit brief repetitive flashes of light. In other modes of operation, the light-emitters $32_1$-$32_x$ of the light source 16 may be activated at different time intervals to display a particular pattern of light (e.g., a light that gradually moves along a length of the second portion 512 of the light-emitting traffic sign 12). While the stroboscopic traffic sign 12 has been described here as comprising two separate portions, in other examples, the stroboscopic traffic sign 12 may comprise a single panel 20 and outer layer 22.

Figure 25:
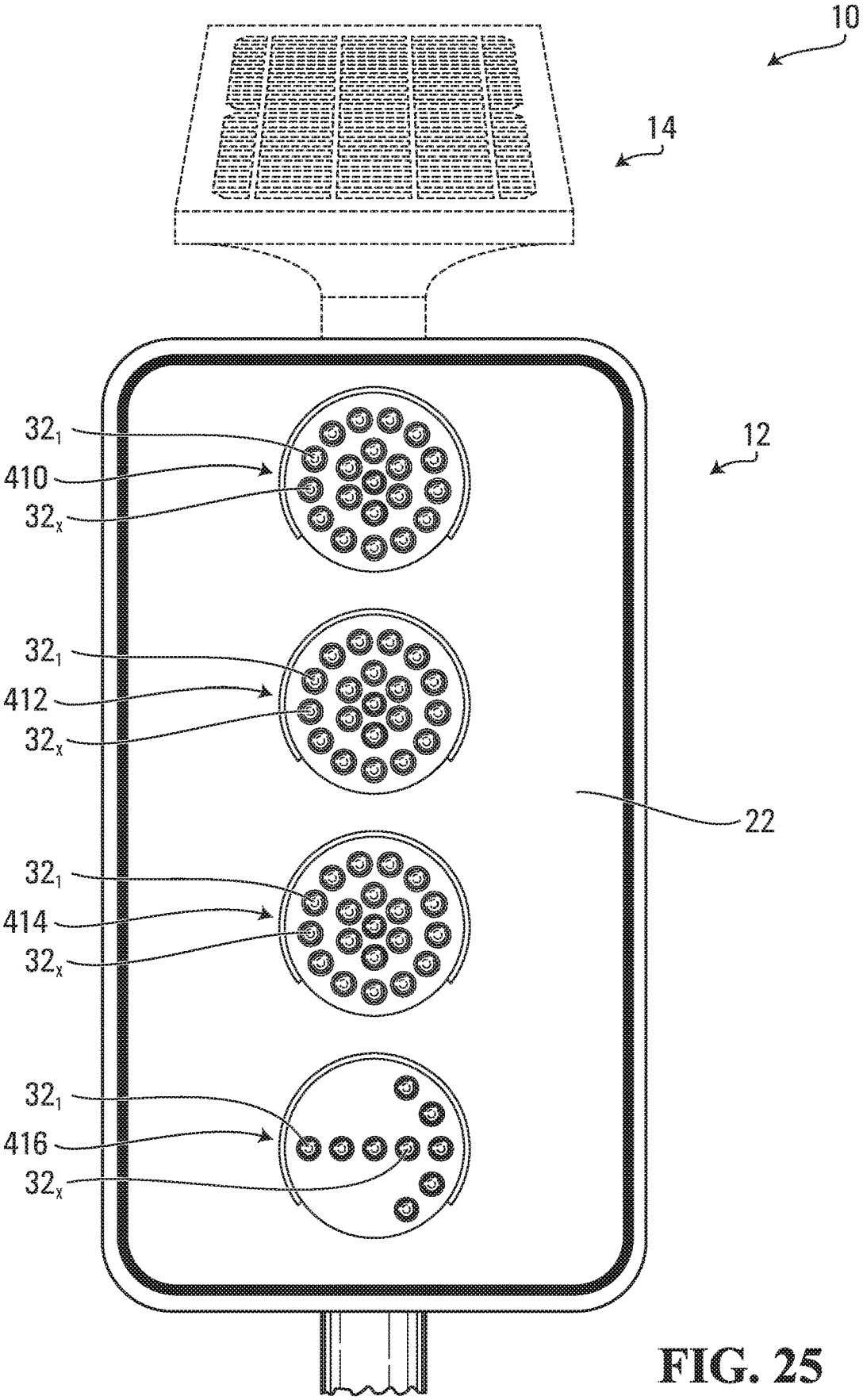
FIG. 25 shows an example of an embodiment in which the light-emitting sign is a traffic light (i.e., a traffic signal)
Figure 26:
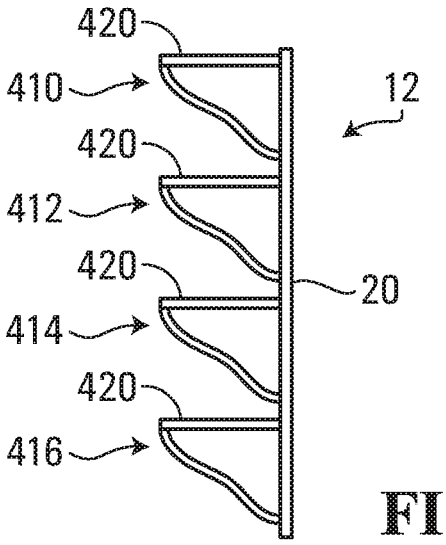
FIG. 26 shows a side view of the traffic light of FIG. 25.

In some embodiments, as shown in FIG. 25, the light-emitting traffic sign 12 may be a traffic light, i.e., a traffic signal or "semaphore", for directing traffic (e.g., at an intersection). The information conveyed by the light source 16 of the traffic light 12 includes commands to drivers of vehicles to perform actions (e.g., stop, advance, turn, etc.). For instance, the light source 16 may comprise a plurality of subsets 410, 412, 414, 416 of the light-emitters $32_1$-$32_x$, each one of the subsets 410, 412, 414, 416 of the light-emitters $32_1$-$32_x$ conveying particular information to an onlooker when illuminated. This may be achieved by assigning a different color and/or configuration to the light-emitters $32_1$-$32_x$ of each subset. For example, the first subset 410 of the light-emitters $32_1$-$32_x$ may be made up of red light-emitters, the second subset 412 of the light-emitters $32_1$-$32_x$ may be made up of yellow light-emitters, the third subset 414 of the light-emitters $32_1$-$32_x$ may be made up of green light-emitters, and the fourth subset 416 of the light-emitters $32_1$-$32_x$ may be configured to form a directional symbol (e.g., an arrow). The traffic light 12 may thus convey to a driver whether he/she may advance, slow down, stop or turn by illuminating one or more of the subsets 410, 412, 414, 416 of the light-emitters $32_1$-$32_x$ in accordance with the established meaning of the color and/or symbol of each subset of the light-emitters $32_1$-$32_x$. As shown in FIG. 26, the traffic light 12 may also comprise a covering member 420 adjacent a respective one of the subsets 410, 412, 414, 416 of the light-emitters $32_1$-$32_x$ for providing shade to each of the subsets 410, 412, 414, 416 of the light-emitters $32_1$-$32_x$. This may improve visibility of the light emitted by the light-emitters $32_1$-$32_x$. Furthermore, in this example, the traffic light 12 is not connected to the external device 14 described above. For instance, the traffic light 12 may be connected to a traffic light controller that supplies power (e.g., from a conventional electrical power grid) to and controls the light source 16 (e.g., illumination of the subsets of the light-emitters $32_1$-$32_x$). Such traffic light controllers are known in the art and will therefore not be described further here. In other cases, the traffic light 12 may be connected to the external device 14 to supply power to and/or control the light source 16 of the traffic light 12.

In other examples of implementation of the traffic light 12, other colors and/or symbols may be presented by the subsets of the light-emitters $32_1$-$32_x$ (e.g., pedestrian crossing/no-crossing symbols). Moreover, while in this example the traffic light 12 is illustrated as comprising four subsets of the light-emitters $32_1$-$32_x$, in other examples the traffic light 12 may comprise more or less subsets of the light the light-emitters $32_1$-$32_x$ (e.g., three subsets, five subsets). While in this embodiment the light-emitting sign apparatus 10 is used for traffic purposes, the light-emitting sign apparatus 10 may be used for any other suitable purpose in other embodiments. For example, in some embodiments, the light-emitting sign apparatus 10 may be used for advertisement purposes such that the light-emitting sign 12 is a light-emitting ad for a business or other organization and/or for a product (i.e., a good or service).

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

To facilitate the description, any reference numeral designating an element in one figure designates the same element if used in any other figures. In describing the embodiments, specific terminology has been resorted to for the sake of description but the disclosure is not intended to be limited to the specific terms so selected, and it is understood that each specific term comprises all equivalents.

In case of any discrepancy, inconsistency, or other difference between terms used herein and terms used in any document incorporated by reference herein, meanings of the terms used herein are to prevail and be used.

Although various embodiments have been illustrated, this was for the purpose of describing, but not limiting, the invention. Various modifications will become apparent to those skilled in the art and are within the scope of this disclosure, which is defined more particularly by the attached claims.

The invention claimed is:

1. A light-emitting sign comprising:

a. a panel;

b. an outer layer; and c. a light source for emitting light, the light source comprising:

i. a plurality of light emitters to emit the light; and ii. a base supporting the light emitters and comprising an electrical circuit configured to deliver power to the light emitters, the base of the light source being disposed between the panel and the outer layer, at least part of each of the light emitters and at least part of the base of the light source being disposed more frontward than the panel.

2. The light-emitting sign of claim 1, wherein a thickness of the outer layer is less than half of a thickness of the panel.

3. The light-emitting sign of claim 1, wherein a thickness of the outer layer is less than one-quarter of a thickness of the panel.

4. The light-emitting sign of claim 1, wherein a thickness of the light source corresponds to at least a majority of a thickness of the light-emitting sign.

5. The light-emitting sign of claim 1, wherein a thickness of the light-emitting sign is no more than 25 millimeters.

6. The light-emitting sign of claim 1, wherein a thickness of the light-emitting sign is no more than 15 millimeters.

7. The light-emitting sign of claim 1, wherein the panel comprises a front surface and a back surface, the outer layer comprises an inner surface facing the front surface of the panel and an outer surface facing away from the front surface of the panel, and a dimension of the light-emitting sign from the back surface of the panel to the outer surface of the outer layer is no more than 20 millimeters.

8. The light-emitting sign of claim 7, wherein the dimension of the light-emitting sign from the back surface of the panel to the outer surface of the outer layer is no more than 10 millimeters.

9. The light-emitting sign of claim 1, wherein the light source is arranged such that at least part of the light is emitted remotely from a border of the light-emitting sign.

10. The light-emitting sign of claim 1, wherein the light source is arranged such that at least part of the light is emitted from a plurality of light-emitting points which are spaced from a periphery of the light-emitting sign by at least one-tenth of a width of the light-emitting sign.

11. The light-emitting sign of claim 1, wherein the light emitters are light-emitting diodes (LEDs).

12. The light-emitting sign of claim 1, wherein respective ones of the light emitters are disposed remotely from a border of the light-emitting sign.

13. The light-emitting sign of claim 1, wherein respective ones of the light emitters are spaced from a periphery of the light-emitting sign by at least one-tenth of a width of the light-emitting sign.

14. The light-emitting sign of claim 1, wherein the light source is arranged such that the light defines at least part of a symbol conveyed by the light-emitting sign.

15. The light-emitting sign of claim 14, wherein the symbol comprises a pictogram.

16. The light-emitting sign of claim 15, wherein the light source is arranged such that the light defines at least part of the pictogram.

17. The light-emitting sign of claim 1, wherein the light source is arranged such that the light defines at least part of a character conveyed by the light-emitting sign.

18. The light-emitting sign of claim 1, wherein the light source is arranged such that the light defines at least part of a text conveyed by the light-emitting sign.

19. The light-emitting sign of claim 1, wherein the base of the light source comprises a printed circuit board including the electrical circuit and the light emitters are mounted to the printed circuit board such that the light defines at least part of a symbol conveyed by the light-emitting sign.

20. The light-emitting sign of claim 1, wherein the light emitters include at least ten light emitters.

21. The light-emitting sign of claim 1, comprising a light-passing cover overlying the light source and permitting the light to pass through the light-passing cover.

22. The light-emitting sign of claim 21, wherein the light-passing cover projects outwardly beyond the outer layer.

23. The light-emitting sign of claim 21, wherein a portion of the light-passing cover is disposed beneath the outer layer.

24. The light-emitting sign of claim 21, wherein the light-passing cover comprises a plurality of light-passing covering elements overlying respective ones of the light emitters.

25. The light-emitting sign of claim 1, wherein the base of the light source comprises a printed circuit board including the electrical circuit.

26. The light-emitting sign of claim 25, wherein a thickness of the printed circuit board is no more than 2 millimeters.

27. The light-emitting sign of claim 25, comprising an electrical insulator between the printed circuit board and the panel.

28. The light-emitting sign of claim 1, wherein the panel is a metallic panel.

29. The light-emitting sign of claim 1, wherein the outer layer is laminated onto the panel over the light source.

30. The light-emitting sign of claim 1, wherein the outer layer comprises a film.

31. The light-emitting sign of claim 1, wherein the outer layer is reflective.

32. The light-emitting sign of claim 1, wherein the outer layer is adhesively bonded to the panel.

33. The light-emitting sign of claim 1, comprising an electrical insulator between the light source and the panel.

34. The light-emitting sign of claim 1, comprising a connector for connecting the light source to an external device comprising a power supply to power the light source.

35. The light-emitting sign of claim 34, wherein the power supply comprises a solar panel.

36. The light-emitting sign of claim 35, wherein the power supply comprises a battery chargeable by the solar panel.

37. The light-emitting sign of claim 36, wherein the battery is a first battery and the power supply comprises a second battery chargeable by the solar panel.

38. The light-emitting sign of claim 34, wherein the external device comprises a controller for controlling the light-emitting sign.

39. The light-emitting sign of claim 38, wherein the controller of the external device is configured to control the light source.

40. The light-emitting sign of claim 38, wherein: the power supply comprises a solar panel and a plurality of batteries that are chargeable by the solar panel; and the controller is configured to selectively cause a given one of batteries to power the light source.

41. The light-emitting sign of claim 40, wherein the controller is configured to selectively cause the given one of the batteries to power the light source based on a charge of the given one of the batteries.

42. The light-emitting sign of claim 38, wherein the external device comprises a housing that houses at least part of the power supply and the controller.

43. The light-emitting sign of claim 38, wherein: the power supply comprises a solar panel; the external device comprises a housing that houses at least part of the power supply and the controller; and the solar panel and the housing are mounted together to enclose the at least part of the power supply and the controller.

44. The light-emitting sign of claim 34, wherein the external device comprises a wireless interface for wirelessly communicating with a remote communication apparatus.

45. The light-emitting sign of claim 1, wherein the light-emitting sign is a light-emitting traffic sign.

46. A light-emitting sign apparatus comprising:

a. the light-emitting sign of claim 1; and b. an external device connectable to the light-emitting sign, the external device comprising:

i. a power supply to power the light source, the power supply comprising a solar panel and a lithium-ion battery;

ii. a controller to control the power supply; and iii. a housing that supports the solar panel and houses at least part of the power supply and the controller.

47. The light-emitting sign of claim 1, wherein at least a majority of the light source is disposed over a frontmost surface of the panel.

48. The light-emitting sign of claim 1, wherein the light source occupies at least a majority of a thickness of the light-emitting sign.

49. The light-emitting sign of claim 1, wherein at least part of the outer layer projects away from the panel to overlie the base of the light source.

50. The light-emitting sign of claim 1, wherein a first portion of the outer layer overlies the base and is farther from the panel than a second portion of the outer layer.

51. The light-emitting sign of claim 1, wherein a portion of the outer layer is adhesively bonded to the base of the light source.

52. The light-emitting sign of claim 1, wherein a first portion of the outer layer is adhesively bonded to the panel and a second portion of the outer layer is adhesively bonded to the base of the light source.

53. The light-emitting sign of claim 1, wherein the panel comprises an opening extending from a front surface of the panel to a back surface of the panel and configured to receive an electrical connection between the light source and an external device comprising a power supply to power the light source.

54. A light source for a light-emitting sign, the light-emitting sign comprising a panel and an outer layer, the light source being configured to emit light and comprising:

a plurality of light emitters to emit the light; and a base supporting the light emitters and comprising an electrical circuit configured to deliver power to the light emitters, the base of the light source being configured to be disposed between the panel and the outer layer such that at least part of each of the light emitters and at least part of the base of the light source are disposed more frontward than the panel.

55. A light-emitting sign comprising:

a. a metallic panel;

b. a reflective outer film; and c. a light source for emitting light, the light source comprising:

i. a plurality of light emitters to emit the light; and ii. a base supporting the light emitters and comprising an electrical circuit configured to deliver power to the light emitters, the base of the light source being disposed between the metallic panel and the reflective outer film, at least part of the reflective outer film projecting away from the panel to overlie the base of the light source.

* * * * *